US007648138B2

(12) United States Patent
Hayashi et al.

(10) Patent No.: US 7,648,138 B2
(45) Date of Patent: Jan. 19, 2010

(54) SHEET HANDLING APPARATUS

(75) Inventors: Shunsuke Hayashi, Otsu (JP); Masahiro Seguchi, Otsu (JP); Masayasu Ueno, Nagakute (JP); Hidetoshi Hata, Nagoya (JP); Hisanori Takemura, Seto (JP); Junji Nishiwaki, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 421 days.

(21) Appl. No.: 11/222,781

(22) Filed: Sep. 12, 2005

(65) Prior Publication Data

US 2006/0070840 A1 Apr. 6, 2006

(30) Foreign Application Priority Data

Sep. 14, 2004 (JP) ..... 2004-266241

(51) Int. Cl.
*B65H 7/02* (2006.01)
*B65H 9/00* (2006.01)
*B65H 9/04* (2006.01)

(52) U.S. Cl. ..... 271/227; 271/253; 271/226

(58) Field of Classification Search ..... 271/3.14, 271/226, 250, 227, 251, 252; 209/534; 194/206
See application file for complete search history.

(56) References Cited

U.S. PATENT DOCUMENTS 4,465,193 A * 8/1984 Kokubo et al. ..... 209/534
4,491,313 A * 1/1985 Schoen ..... 271/194
4,510,380 A * 4/1985 Uchida et al. ..... 194/206
4,630,813 A * 12/1986 Watanabe et al. ..... 271/227
4,905,841 A * 3/1990 Hirata et al. ..... 209/534
5,076,441 A * 12/1991 Gerlier ..... 209/534
5,140,166 A * 8/1992 Gerlier ..... 250/548
5,169,140 A * 12/1992 Wenthe, Jr. ..... 271/228
5,465,953 A * 11/1995 Takemoto et al. ..... 271/234
5,499,805 A * 3/1996 Anma ..... 271/3.05

(Continued)

FOREIGN PATENT DOCUMENTS

EP 1 731 456 12/2006

(Continued)

*Primary Examiner*—Patrick H Mackey
*Assistant Examiner*—Patrick Cicchino
(74) *Attorney, Agent, or Firm*—Antonelli, Terry, Stout & Kraus, LLP.

(57) ABSTRACT

A sheet handling apparatus is proposed to be able to stably shift a position of a sheet. A sheet handling apparatus comprises: conveyance device for conveying a sheet; shift device, rotating in a direction inclined relative to a direction of conveyance of the sheet, for coming into contact with the sheet to shift a position of the sheet in a widthwise direction of conveyance; and shift presence and absence switching device for switching between a shift execution state, in which shift of the sheet is executed by the shift device, and a shift non-execution state, in which the shift is not executed by the shift device; wherein at least a part of that contact portion of the shift device, which comes into contact with a surface of the sheet, is positioned at a side of a shift direction relative to the conveyance device, which has a conveyance force during shift, and a frictional force of the shift device on the sheet at the time of execution of shift is set to be larger than that of the conveyance device on the sheet.

14 Claims, 23 Drawing Sheets

U.S. PATENT DOCUMENTS

| | | | | |
|---|---|---|---|---|
| 5,564,544 | A * | 10/1996 | Takemoto et al. | 194/206 |
| 5,697,609 | A | 12/1997 | Williams | |
| 5,755,437 | A * | 5/1998 | Ek | 271/227 |
| 6,059,284 | A * | 5/2000 | Wolf et al. | 271/227 |
| 6,267,372 | B1 * | 7/2001 | Mylaeus et al. | 271/250 |
| 6,327,543 | B1 * | 12/2001 | Nakajima et al. | 702/66 |
| 6,712,356 | B2 * | 3/2004 | Daout et al. | 271/250 |
| 6,811,152 | B2 | 11/2004 | Delfosse | |
| 2001/0045697 | A1 * | 11/2001 | Daout et al. | 271/266 |
| 2003/0057637 | A1 * | 3/2003 | Kawamura et al. | 271/227 |
| 2003/0196936 | A1 * | 10/2003 | Graef et al. | 209/534 |
| 2006/0214363 | A1 | 9/2006 | Kawashima | |
| 2007/0023995 | A1 | 2/2007 | Onodera | |
| 2007/0235920 | A1 | 10/2007 | Kawashima | |

FOREIGN PATENT DOCUMENTS

| | | |
|---|---|---|
| JP | 5-12529 | 1/1993 |
| JP | 06001498 | 1/1994 |
| JP | 9-194081 | 7/1997 |

* cited by examiner

SHEET HANDLING APPARATUS

This application claims the benefit of priority of Japanese Application No. 2004-266241 filed Sep. 14, 2004, the disclosure of which also is entirely incorporated herein by reference.

BACKGROUND OF THE INVENTION

The present invention relates to a sheet handling apparatus, in which, for example, a sheet is arranged in position during conveyance.

Conventionally, there are provided apparatuses, in which paper notes are accumulated, paid out, or the like, and which are incorporated into an apparatus for handling of paper notes, such as ATM.

Plural kinds exist in paper notes and sizes differ according to the kinds. Accordingly, in case of handling various kinds of paper notes, positional adjustment in a conveyance path is needed to store paper notes in cassettes when it is tried to hold paper notes in cassettes suited to sizes thereof by kinds.

As measures to perform such positional adjustment, there has been proposed a medium handling apparatus comprising a straight conveyance roller provided centrally in a conveyance path and skew conveyance rollers provided on both sides of the straight conveyance roller to put paper notes (medium) to the center (see JP-A-9-194081).

With the medium handling apparatus, paper notes are conveyed by the straight conveyance roller arranged in the center and when paper notes are to be put to the center, the straight conveyance roller is retreated and the skew conveyance roller (for example, one on the right) is energized to put paper notes to the center.

Since at the time of putting to the center, paper notes are momentarily released freely without contacting with any one of the straight conveyance roller and the skew conveyance rollers, however, there is caused a problem that handling is impaired in stability.

Assuming a construction, in which the skew conveyance rollers are energized and then the straight conveyance roller is retreated, there is caused a problem that paper notes are deformed by the both rollers, which are different in direction of rotation, to cause paper jam.

Further, since the skew conveyance roller is energized midway paper notes being conveyed to cause shift, there is caused a problem that a distance, in which shift is made effective, is shorter than a length of paper notes in a direction of conveyance and thus shift is small in magnitude.

Also, since one skew conveyance roller is used at the time of putting to the center, skew is in some cases generated at the time of putting to the center. That is, while the skew conveyance roller has an appropriate width, skew is in some cases generated because a biasing force at one end of the roller becomes strong according to machining accuracy when paper notes are biased, and pressure is concentrated on one point. Further, there are problems that obstruction occurs upon storing since a structure to monitor a sheet condition as to whether shift correction has been correctly executed or not after shift correction is executed is not provided and that in a circulation type automatic teller machine having a function to pay out again a paper note which has been stored once, obstruction in pay out occurs since shift correction has not been performed correctly.

Also, another related art for positional adjustment proposes the provision of an oscillating conveyance belt (see JP-A-5-12529). Since the oscillating conveyance belt is large in mass, however, it is difficult to feedback control a shift mechanism while measuring movements of paper notes during correction of shift to provide for an accurate shift.

SUMMARY OF THE INVENTION

In view of the above described problems, it is an object of the invention to provide a sheet handling apparatus capable of stably displacing a position of a sheet.

The invention is characterized in that a sheet handling apparatus comprises: conveyance means including a conveyance path for conveying a sheet; a discrimination part to discriminate authenticity and denomination of a sheet conveyed; a hold part to temporarily hold the sheet; a shift means to shift position of the sheet in a width direction of the conveyance; wherein the shift means is provided on a conveyance path connecting the hold part and the discrimination part. By providing the shift means, upon paying out the paper notes, it is possible to convey paper notes, which are judged at the discrimination part as normal, in an aligned state to a pay out port (or pay in and out port). Alternatively, upon paying in the paper notes, it is possible to store the paper notes, which have been judged by the discrimination part as normal, in a storing cassette in an alignment state. On account of the operation to align the paper notes as described above, it is possible to accumulate the paper notes in an aligned state to a target place even when paper notes of which width are different from each other are mixedly handled, for example.

Further, by providing a structure in which a positional detection means to detect a position of sheets, which are conveyed to the discrimination part, in a conveyance widthwise direction is provided and the sheets are sorted into respective receipt parts on the basis of result detected by the detection means, when received paper notes are temporarily received in the hold part to store them into inside, the shift means performs the shift correction of the paper notes and the discrimination part, which is located at the downstream side of the conveyance path, checks whether the shift correction is correctly performed or not. When it judges that the shift correction is correctly performed, the paper notes are sorted into receiving boxes for respective denominations. When it judges that the shift correction is incomplete or abnormal, the paper notes are sorted into a recovery box. Therefore, the paper notes received in the receiving box for respective denominations are in an aligned state capable of paying out again.

Further, the shift means is provided on the conveyance path located at the most upstream position of the sheet handling apparatus. Therefore, even when the shift correction is not normally performed by the shift means and a paper note being conveyed is jammed and conveyance obstruction occurs, it is possible to easily remove the jammed paper note.

The invention is characterized in that a sheet handling apparatus comprises: conveyance means for conveying a sheet; shift means, rotating in a direction inclined relative to a direction of conveyance of the sheet, for coming into contact with the sheet to shift a position of the sheet in a widthwise direction of conveyance; and shift presence and absence switching means for switching between a shift execution state, in which shift of the sheet is executed by the shift means, and a shift non-execution state, in which the shift is not executed by the shift means; wherein at least a part of that contact portion of the shift means, which comes into contact with a surface of the sheet, is positioned at a side of a shift direction relative to the conveyance means, which has a conveyance force during shift, and a frictional force of the shift means on the sheet at the time of execution of shift is set to be larger than that of the conveyance means on the sheet.

The conveyance means comprises means for conveyance of a sheet, such as a conveyance belt pair to interpose a sheet from both surfaces and convey the same with conveyance belts provided opposingly; a conveyance belt provided in opposition to a fixed plate shaped member, such as a metallic plate, a resin plate, etc., of which surface is slippery; a conveyance roller pair comprising a plurality of conveyance rollers provided opposingly in a direction of conveyance to interpose a sheet from both surfaces to convey the same; or a plurality of conveyance rollers provided in opposition to a fixed plate shaped member, such as a metallic plate, a resin plate, etc., of which surface is slippery, in a direction of conveyance, or the like.

In addition, the use of a conveyance belt is preferable in view of manufacturing cost, and further the use of a conveyance belt pair is desirable in view of stability.

The shift means includes formation with one or more bodies of rotation. The bodies of rotation include a cylindrical-shaped roller, a disk, or a belt stretched round a plurality of rollers to revolve.

In addition, the use of a roller or a disk is desirable in view of manufacturing cost and miniaturization, and the use of a roller is desirable in view of prevention of damage on a sheet.

The shift presence and absence switching means is constructed such that a sheet conveyed by the shift means is pushed with a necessary pressure in the shift execution state and a pushing force of the shift means on a sheet is decreased in the shift non-execution state to separate the shift means from the sheet, or bring the shift means into light contact with the sheet to an extent that no shift is caused.

During the execution of shift, a conveyance speed of the conveyance means and a rotating speed of a component of rotation of the shift means in a direction of conveyance are the same, or the rotating speed of the shift means is higher than the conveyance speed, or the rotating speed of the shift means is lower than the conveyance speed.

In addition, in the case where the shift means comprises one body of rotation, the rotating speed of the component of the shift means in the direction of conveyance and the conveyance speed of the conveyance means are desirably made the same to prevent skew.

Also, in the case where the shift means comprises two or more bodies of rotation, the rotating speed of the component of the shift means in the direction of conveyance is desirably set to be higher than the conveyance speed of the conveyance means to make shift in a manner to extract a sheet in conveyance.

The conveyance means having a conveyance force during the shift comprises conveyance means that continues a motion of conveyance in the same state as a normal state of conveyance, or in a state near thereto. Accordingly, the conveyance means comprises only conveyance means having a conveyance force during the shift, or comprises, in addition thereto, conveyance means that retreats only during shift to have no conveyance force during shift.

With such construction, shift may be executed stably because there is no need of separating the conveyance means from a sheet when a sheet during shift is to be shifted in a widthwise direction of conveyance. That is, since the conveyance means continues conveyance and only during shift, the shift means may forcedly shift a sheet with a larger frictional force than that of the conveyance means, it is possible to prevent a sheet from being released momentarily before and after shift to be unstable as conventionally occurred. Accordingly, it becomes possible to stably perform putting to the center, putting to the right side, putting to the left side, or putting to other positions.

In an embodiment of the invention, the conveyance means may comprise a conveyance belt stretched round an appropriate rotating member and a drive unit that drivingly rotates the rotating member.

Thereby, it is possible to make conveyance of a sheet further stable to prevent inadvertent positional deviation during conveyance.

In an embodiment of the invention, the shift means may comprise two or more bodies of rotation juxtaposed in the widthwise direction of conveyance.

Thereby, it is possible to prevent for a sheet from skewing when displacing the sheet. The skew indicates out of alignment of direction of a sheet and means that a sheet being conveyed is inclined relative to the conveyance direction over limitation within which no problem occurs in process.

In an embodiment of the invention, the conveyance means having a conveyance force also during shift of the sheet may be arranged between the bodies of rotation in juxtaposition.

Thereby, a sheet being conveyed by the conveyance means may be forcedly shifted in position by the bodies of rotation in juxtaposition and it is possible to prevent a sheet from being subjected to breakage, bending, or skew at the time of the positional shift.

That is, since the bodies of rotation in juxtaposition come into contact with a sheet with a larger frictional force than that of the conveyance means, the sheet is put in a state of being firmly held at two points by the left and right bodies of rotation even when the conveyance means conveys the sheet.

Accordingly, the sheet during positional shift is put in a state of being pulled at two points and undergoes positional shift while being maintained in posture against the frictional force of the conveyance means in the meantime, so that breakage or bending is not generated in the sheet and skew may be prevented.

Also, in an embodiment of the invention, the conveyance means having a conveyance force also during shift of the sheet may be arranged on a side opposite to any one of the two or more bodies of rotation in the direction of conveyance caused by the bodies of rotation.

Thereby, since a sheet during positional shift is put in a state of being pulled by the conveyance means, the conveyance means does not obstruct positional shift of the sheet and the sheet may stably undergo positional shift.

Also, in an embodiment of the invention, the conveyance means having a conveyance force also during shift forms first conveyance means, and there may be provided second conveyance means provided at further side of the shift direction than the bodies of rotation positioned at the side of the shift direction, and pushing-force switching means that increases a pushing force of the second conveyance means on the sheet to cause the same to cooperate with the first conveyance means to convey the sheet when the sheet is not to be shifted, and decreases the pushing force on the sheet so as not to obstruct shift of the sheet when the sheet is to be shifted.

In the case where the second conveyance means comprises a conveyance belt pair, of which conveyance belts stretched round appropriate rollers are opposingly provided, the pushing-force switching means comprises moving means that moves a part or all of rollers on one of the conveyance belts in a direction opposed to the other of the conveyance belts. At this time, there is included a state, in which the opposed conveyance belts come into contact with each other with a small pushing force, a state of light contact with no pushing force, or a state of separation.

With such construction, a plurality of conveyance means may stably convey a sheet in a manner not to skew the same during conveyance, and the conveyance means in a direction of shift may be prevented from obstructing positional shift at the time of positional shift.

Also, in an embodiment of the invention, the construction may be made such that the conveyance belt is provided opposingly on upper and lower sides to have conveyance surfaces abutting against each other to form a conveyance belt pair; the conveyance belt pair is provided two in juxtaposition in a widthwise direction of conveyance; the respective conveyance belt pairs are provided with pushing-force switching means for switching of a pushing force on the conveyance surface; the shift means comprises four pairs of bodies of rotation with the bodies of rotation provided opposingly on upper and lower sides and with directions of rotations inclined inward relative to the direction of conveyance; the respective pairs of bodies of rotation are arranged in positions, in which the conveyance belt pair is interposed between two pairs of bodies of rotation in the widthwise direction of conveyance, for the respective conveyance belt pairs; the shift presence and absence switching means is constructed to switch every two pairs of bodies of rotation, which interpose therebetween the conveyance belt pair, between a shift execution state, in which the upper and lower bodies of rotation are caused to approach each other to execute shift of the sheet, and a shift non-execution state, in which the upper and lower bodies of rotation are separated from each other not to execute shift of the sheet; and when a sheet on a right side is to be put to a center, two pairs of bodies of rotation, which interpose therebetween the conveyance belt pair on the right side, is switched over to the shift execution state and a pushing force of the conveyance belt pair on a left side is decreased, and when a sheet on the left side is to be put to the center, two pairs of bodies of rotation, which interpose therebetween the conveyance belt pair on the left side, is switched over to the shift execution state and a pushing force of the conveyance belt pair on the right side is decreased.

Thereby, even when a sheet being conveyed is disposed to either the left side or the right side, it may be stably put to the center.

The invention makes it possible to shift a position of a sheet in the widthwise direction of conveyance.

Other objects, features and advantages of the invention will become apparent from the following description of the embodiments of the invention taken in conjunction with the accompanying drawings.

DESCRIPTION OF THE EMBODIMENTS

An embodiment of the invention will be described hereinafter with reference to the drawings.

First, a whole construction and control of a paper notes shift apparatus 1 will be described with reference to FIG. 1 which is a cross sectional plan view of an upper mechanism shown, FIG. 2 which is a cross sectional plan view of a lower mechanism, FIG. 3, which is a partially enlarged plan view of the lower mechanism, FIG. 4 which is a right side cross sectional view of a conveyance mechanism, FIG. 5 which is a right side cross sectional view of a shift mechanism, FIG. 22 which is a view of a paper note handling machine, and FIGS. 23A, 23B, and 23C which are views showing paper note conveyance paths of the paper note handling machine.

Figure 22:
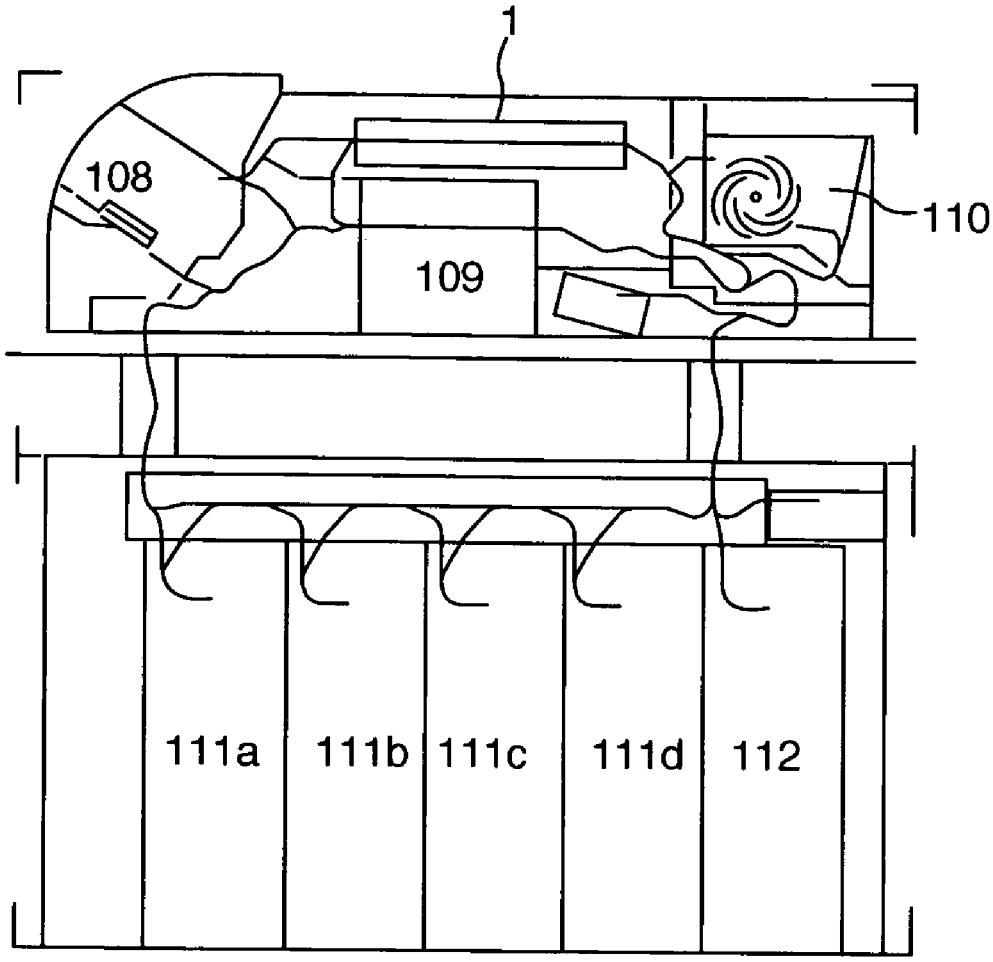
FIG. 22 is a view of a paper note handling machine.

As shown in FIG. 22, a paper note handling machine (which is a paper note unit provided inside an ATM) is constituted by a pay-in and pay-out mouth 108 (or a pay-in mouth) which receives paper notes from outside or pays out paper notes accumulated inside, a discrimination part 109 which discriminates authenticity and denominations of paper notes which are received or to be paid-out, a temporary hold part 110 which temporarily holds normal paper notes discriminated by the discrimination part, storing cassettes 111 (111*a*-111*d*) which store the paid-in paper notes held in the temporary hold part every denominations (or in a lump) or pay out the accumulated paper notes every denominations (or in a lump) through the pay-in and pay-out mouth 108 as pay-out paper notes, a reject recovery box 112 which recovers those paper notes that are judged at the discrimination part 109 to be abnormal or are not able to be judged at the discrimination part 109 upon paying out from the storing cassettes 111 (111*a*-111*d*) as pay-out paper notes, and the like.

The paper note handling machine is provided with a paper note shift apparatus 1 therein and the paper note shift apparatus is located on a conveyance path between the pay-out mouth 108 (or pay-out and pay-in mouth) and the temporary hold part 110 as shown in FIG. 22

Figure 23A:
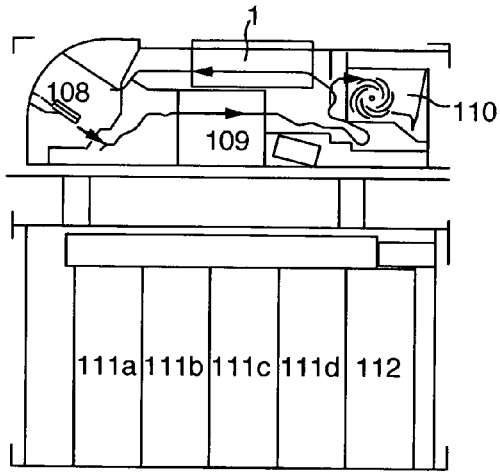
FIGS. 23A, 23B, and 23C are views showing paper note conveyance paths of the paper note handling machine.
Figure 23B:
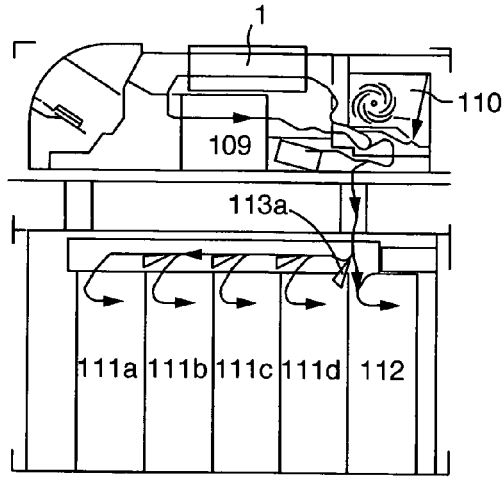
Figure 23C:
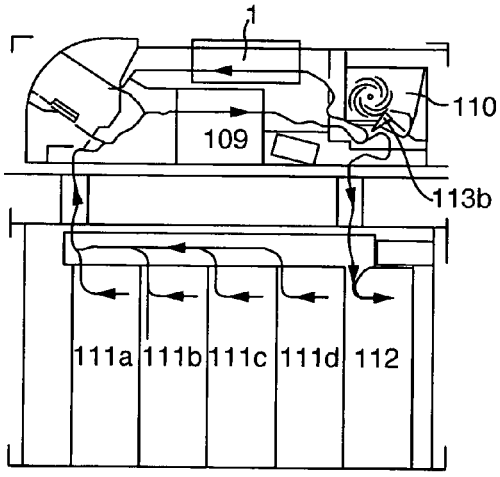

FIGS. 23A, 23B and 23C show conveyance paths of paper notes of process to count the paid-in paper notes, process to store the paid-in paper notes and process to pay out the paper notes executed in the paper note handling machine. Each process will be described hereinafter.

First, control at pay-in will be described. FIG. 23A shows a conveyance path in the process of pay-in. The paper notes put into the pay-in and pay-out mouth 108 are led to the discrimination part 109. When the paper notes are judged at the discrimination part 109 to be normal paper notes, they are conveyed to the temporary hold part 110 to be temporarily held therein. When the paper notes are not judged at the discrimination part 109 to be normal paper notes, they are returned to the pay-in and pay-out mouth 108. The paper notes pass through the paper note shift apparatus 1 when they are returned to the pay-in and pay-out mouth 108 but in this returning operation, the paper note shift apparatus 1 does not conduct any action.

Next, control upon storing the paid-in paper notes to store the paper notes temporarily held in the temporary hold part 110 into the respective cassettes will be described. FIG. 23B shows a conveyance path upon storing. The paper held in the temporary hold part 110*a* are passed through the paper notes shift apparatus 1, and are discriminated at the discrimination part 109 again, and conveyed to the storing cassettes disposed at downstream of the conveyance path (lower portion in figures). At this time, when the paper notes pass through the paper note shift apparatus 1, those paper notes, which need shift correction, receive shift correction and the discrimination part 109 provided at the downstream of the conveyance path judges whether the shift correction is correctly performed or not. When it is judged at the discrimination part 109 that the shift correction is performed correctly, the paper notes are stored in the storing cassettes. When it is judged at the discrimination part 109 that the shift correction is not completed or is abnormal, the paper notes are sorted at a sorting mechanism 113*a* to be stored in the reject recovery box 112. With the structure, the paper notes stored in the receiving cassettes for every denomination are in aligned state capable of being paid out again. Even when paper notes to be handled comprise plural kinds of paper notes having different width, the paper notes are stored in the storing cassettes 111 (111*a*-111*d*) in aligned state and it is possible to keep a state capable of being paid-out again upon paying out the paper notes. Alternatively, a structure in which the paper note shift apparatus 1 is provided at the downstream of the discrimination part may be sufficient since there is no fear that the function itself of the paper note shift apparatus 1 becomes impaired.

Control upon paying out paper notes will be described. FIG. 23C shows a conveyance path of paper notes upon paying out paper notes. The paper notes accumulated in the storing cassettes 111(111*a*-111*d*) beforehand are conveyed to the discrimination part 109 and the discrimination part 109 judges whether the paper notes are abnormal paper notes or not or they are not able to be discriminated. When the paper notes are judged to be abnormal or not to be able to be discriminated, they are recovered to the reject recovery box 112 by the sorting mechanism 113*b*. When the paper notes are judged to be normal, they are conveyed to the paper note shift apparatus 1. Those paper notes which require shift correction receive shift correction at the paper note shift apparatus and conveyed to the pay-in and pay-out mouth 108. In this case, judgment of whether the shift correction has been conducted normally is not conducted and the paper notes are only conveyed to the pay-in and pay-out mouth 108. Since re-paying out is not needed, no obstruction occurs even if the shift correction has not been normally conducted.

As described above, when the paper note shift apparatus 1 is provided in the paper note handling machine, there is characteristic feature in structure that (1) the paper note shift apparatus is provided on the way of the conveyance path from the temporary hold part 110 to the discrimination part 109 or (2) the paper note handling apparatus is provided on the conveyance path located at the most upstream of the paper note handling machine.

According to the characteristic feature (1), it is not true that the posture of the paper notes are corrected in accordance with the discrimination result at the discrimination part 109 but the posture of the paper notes are detected by specific sensors to be corrected as described later as to the description of the paper note shift apparatus 1, so that thereafter, the corrected result can be confirmed at the discrimination part 109. Whereby, there are advantages that it is possible to change the storage location, that is, conveyance location and even if the paper note shift apparatus 1 could not correct the posture of the paper notes, the paper notes can be stored in the reject recovery box 112.

According to the characteristic feature (2), it is possible to remove the jam of the paper notes. While the paper note shift apparatus 1 has a function to correct the posture of the paper notes, the apparatus 1 is a complex mechanism as described later. With this, if correction of the paper notes by the mechanism is failed, jam of paper notes occurs. Thus, by locating the paper note shift apparatus at the most upstream, an operator can easily remove the jammed paper notes even when jam of paper note occurs.

As described above, the process of paying in the paper notes includes counting and storing of the paid-in money. The paper note shift apparatus 1 performs the correction of the paper notes only at the storing of the paid-in money. With this, it is possible to provide an apparatus suitable for the recycle of the paper notes and it is possible to avoid unnecessary jam of paper notes.

The paper notes shift apparatus 1 is incorporated into an ATM and provided between a temporary holding unit, which temporarily holds paper notes, and cassettes, which store paper notes. Since the temporary holding unit is provided in a leading stage of the paper notes shift apparatus 1 and the cassettes are provided in a trailing stage of the paper notes shift apparatus 1, the paper notes shift apparatus 1 is constructed to convey paper notes, which are taken out from the temporary holding unit, from an upper to down in FIG. 1 to store the same in the cassettes.

An ATM comprises a control unit that performs various control processes, a touch monitor having a function of display and a function of input operation, a passbook processing unit that processes a passbook, a card processing unit that processes a magnetic card, a coin processing unit that performs determination of authenticity and denomination of coins, a paper note processing unit that performs determination of authenticity and denomination of paper notes, a detailed statement processing unit that issues a detailed statement, a journal processing unit that records the same information as that of a detailed statement, a center communication processing unit that communicates with a center, a remote monitoring apparatus communication processing unit that communicates with remote monitoring apparatuses to perform failure recovery or the like, and a staff panel processing unit that permits a staff to perform recovery or the like.

The paper notes shift apparatus 1 may be mounted not only in an ATM (automatic transaction machine) but also in currency exchange machines, ticket machines, medal selling machines, or commodity automatic vending machines, other apparatuses that handle paper notes.

Figure 1:
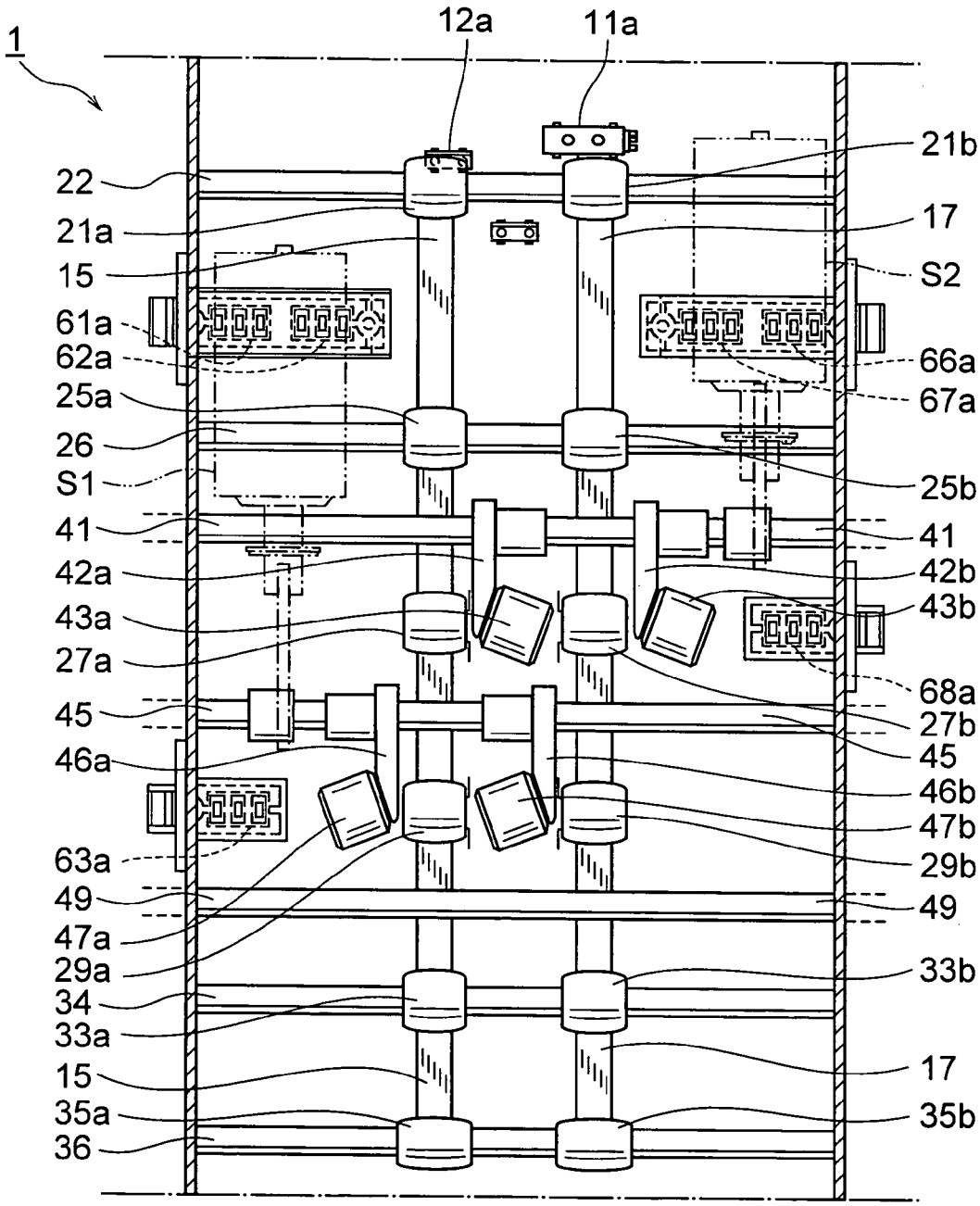
FIG. 1 is a cross sectional plan view of an upper mechanism of a paper notes shift apparatus.

The paper notes shift apparatus 1 comprises two left and right conveyance belts 15, 17 (upper portions of which are not partially shown) disposed in an upper region as shown in FIG. 1. The conveyance belts 15, 17 are stretched round rollers 21

Figure 4:
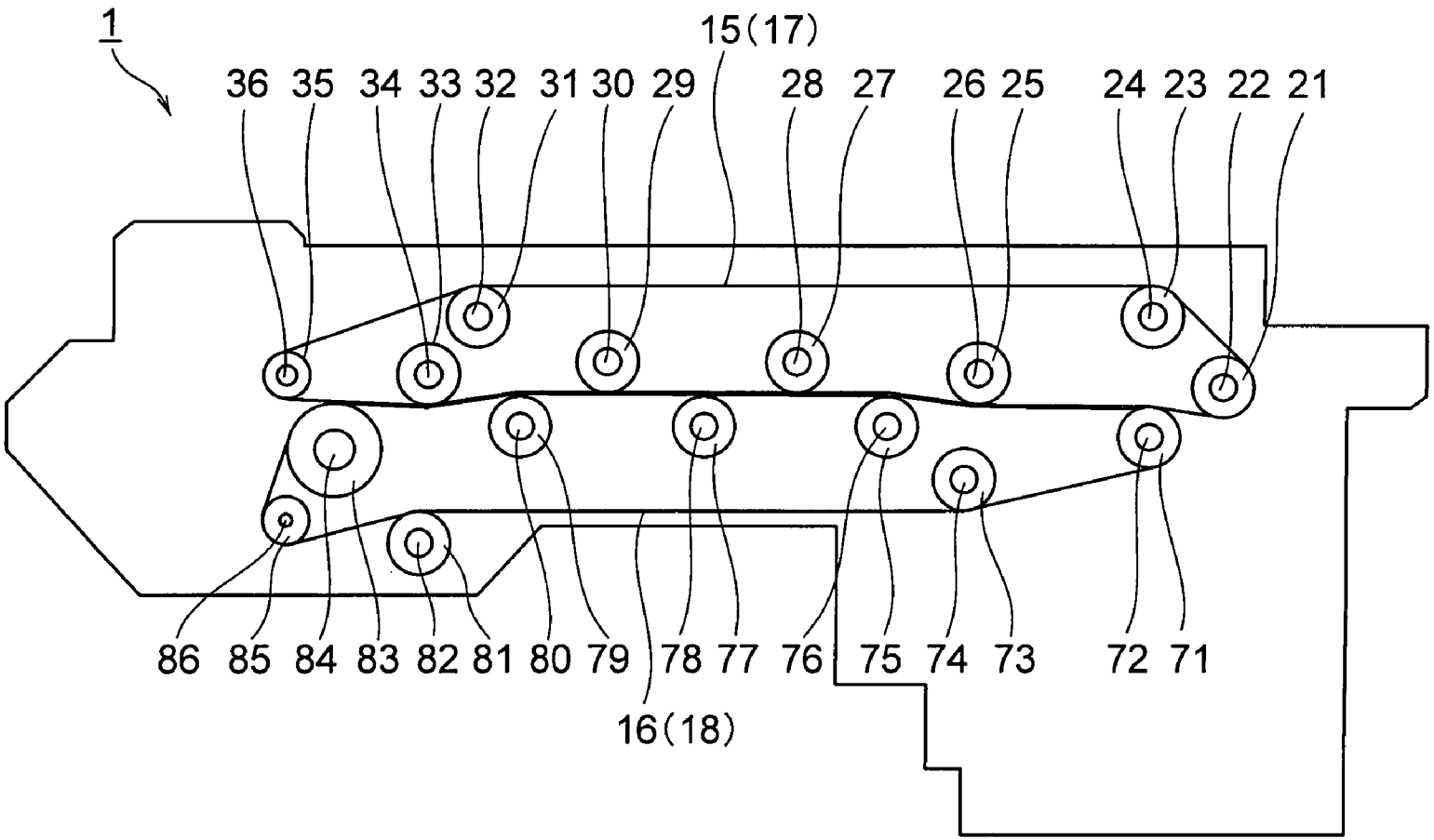
FIG. 4 is a right side cross sectional view of a conveyance mechanism of the paper notes shift apparatus.

(21*a*, 21*b*), 23, 25 (25*a*, 25*b*), 27 (27*a*, 27*b*), 29 (29*a*, 29*b*), 31, 33 (33*a*, 33*b*), 35 (35*a*, 35*b*), surfaces of which are formed from a rubber member, as shown in FIG. 4 and revolve in a direction of conveyance by obtaining a rotational force of a motor M3 (FIG. 13) described later.

The respective rollers are appropriately fitted rotatably onto shafts, etc. and provided to be left-right symmetric as shown in FIGS. 1 and 4. More specifically, the rollers 21*a*, 21*b* are provided on a shaft 22 as shown in FIG. 1. The rollers 25*a*, 25*b* are provided on a shaft 26. The rollers 33*a*, 33*b* are provided on a shaft 34. The rollers 35*a*, 35*b* are provided on a shaft 36. As shown in FIG. 4, the rollers 23, 23 are provided on a shaft 24. The rollers 31, 31 are provided on a shaft 32.

The rollers 27*a*, 27*b* and the rollers 29*a*, 29*b* are mounted directly and rotatably on a housing as shown by shade lines in FIG. 1 for free rotation. Specifically, the housing is provided with a cover (depiction of which is omitted), which is formed with holes in locations required for the conveyance belts 15, 17, various kinds of sensors (detection means), etc. to define a conveyance path. The rollers 27*a*, 27*b* and the rollers 29*a*, 29*b* are mounted to the cover.

The rollers 21, 23, 25, 27, 29, 31, 33, 35 are fixed in positions so as to rotate in determined positions. As shown in FIG. 4, the rollers 27 and the rollers 29 are provided horizontally so as to become the same in level. The roller 25 and the roller 33 are provided horizontally so as to become the same in level, and the rollers 25, 33 are provided with a difference in level to be made a little lower than the rollers 27, 29.

An upper mechanism shown in FIG. 1 comprises skew execution rollers 43 (43*a*, 43*b*) and skew execution rollers 47 (47*a*, 47*b*), surfaces of which are formed from a rubber member.

The skew execution rollers 43 are provided for rotation at tip ends of respective arms 42 (42*a*, 42*b*) fixed to a shaft 41. The skew execution rollers 43 are positioned laterally of the rollers 27 with directions of rotation thereof inclined so that a discharge side (downward in FIG. 1) is made inside (leftward in FIG. 1) relative to the direction of conveyance (from above to down in FIG. 1). The two skew execution rollers 43*a*, 43*b* are set to the same angle in inclination so that directions of rotation of the both are made in parallel to each other.

The skew execution rollers 43*a*, 43*b* are juxtaposed with each other so as to interpose therebetween the right conveyance belt 17 from left and right. A solenoid S2 is connected to the shaft 41. Thereby, the solenoid S2 simultaneously moves the arms 42*a*, 42*b* over the same distance to make pivotal movements in a vertical direction, thereby simultaneously moving the skew execution rollers 43 over the same distance in the vertical direction.

The skew execution rollers 47 are provided for rotation at tip ends of respective arms 46 (46*a*, 46*b*) fixed to a shaft 45. The skew execution rollers 47 are positioned laterally of the rollers 29 with directions of rotation thereof inclined so that a discharge side (downward in FIG. 1) is made inside (rightward in FIG. 1) relative to the direction of conveyance (from above to down in FIG. 1). The two skew execution rollers 47*a*, 47*b* are set to the same angle in inclination so that directions of rotation of the both are made in parallel to each other.

The skew execution rollers 47*a*, 47*b* are juxtaposed with each other so as to interpose therebetween the left conveyance belt 15 from left and right. A solenoid S1 is connected to the shaft 45. Thereby, the solenoid S1 simultaneously moves the arms 46*a*, 46*b* over the same distance to make pivotal movements in the vertical direction, thereby simultaneously moving the skew execution rollers 47*a*, 47*b* over the same distance in the vertical direction.

In an upstream position of the conveyance path in the upper mechanism, a paper notes interval detection LED11*a*, a skew detection LED12*a*, shift execution floodlight units (61*a*, 62*a*, 66*a*, 67*a*), a leftward-shift termination LED group 68*a*, and a rightward-shift termination LED group 63*a* are provided in this order and in the order from a taking-in side (an upper side in FIG. 1) of paper notes.

The shift execution floodlight units comprises a rightward-shift start LED group 61*a* and a leftward-shift start LED group 66*a*, which are provided left-right symmetric in the vicinity of side walls of the conveyance path, and a leftward-shift stop LED group 62*a* and a rightward-shift stop LED group 67*a*, which are provided left-right symmetric inside of the rightward-shift start LED group and the leftward-shift start LED group, and these LED groups are arranged in a lateral row.

The rightward-shift start LED group 61*a* and the leftward-shift stop LED group 62*a* are paired and provided on the left of the conveyance path, and the rightward-shift stop LED group 67*a* and the leftward-shift start LED group 66*a* are paired and provided on the right of the conveyance path.

All the rightward-shift start LED group 61*a*, the leftward-shift stop LED group 62*a*, the leftward-shift start LED group 66*a*, and the rightward-shift stop LED group 67*a* are formed by juxtaposing three LEDs laterally.

The leftward-shift termination LED group 68*a* is arranged in a position on the lateral and right side of the skew execution rollers 43 and formed by juxtaposing three LEDs laterally in those positions, which are the same in a conveyance widthwise direction as those of the leftward-shift start LED group 66*a*.

The rightward-shift termination LED group 63*a* is arranged in a position on the lateral and left side of the skew execution rollers 47 and formed by juxtaposing three LEDs laterally in those positions, which are the same in the conveyance widthwise direction as those of the rightward-shift start LED group 61*a*.

Figure 2:
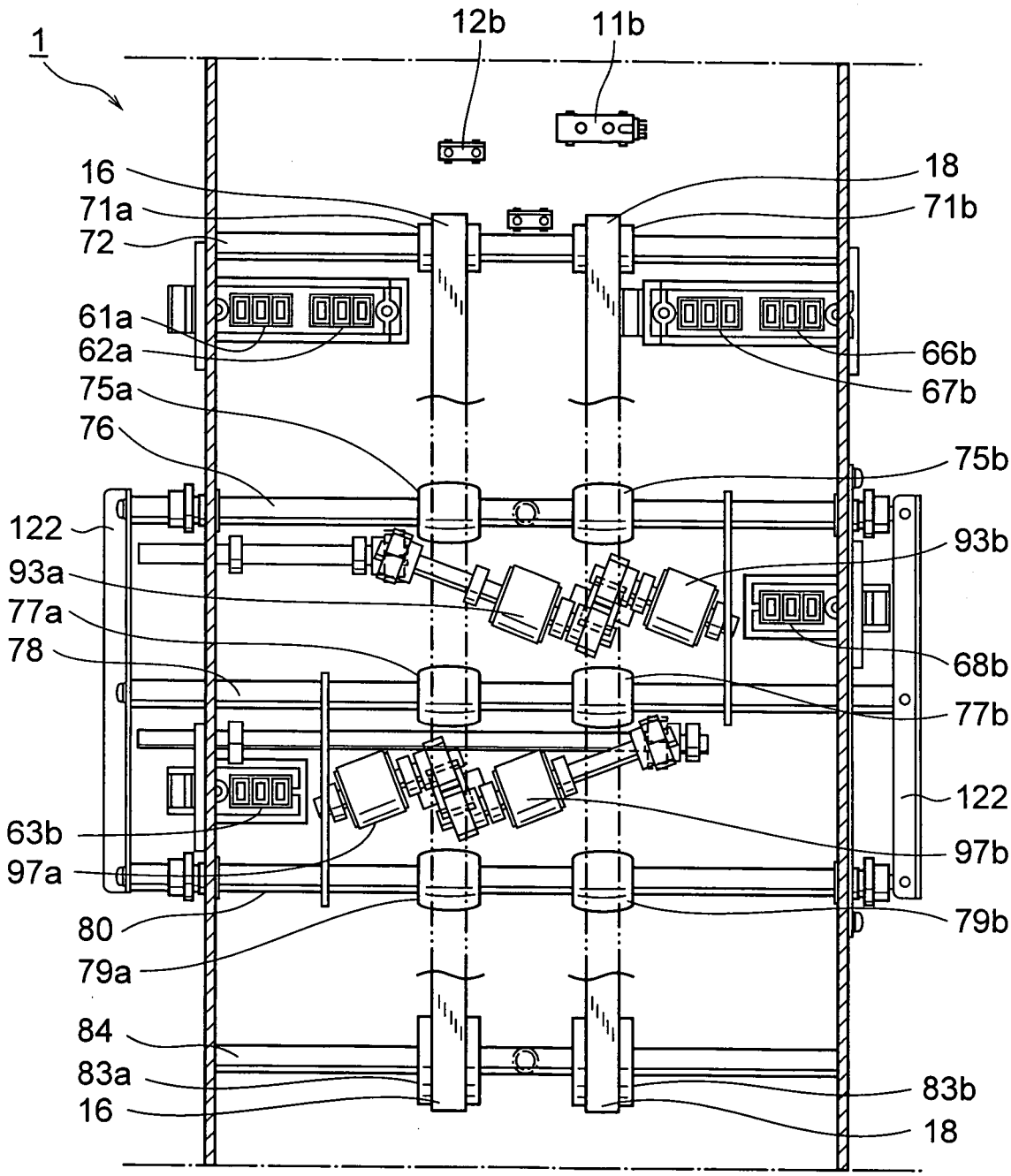
FIG. 2 is a cross sectional plan view of a lower mechanism of the paper notes shift apparatus.
Figure 3:
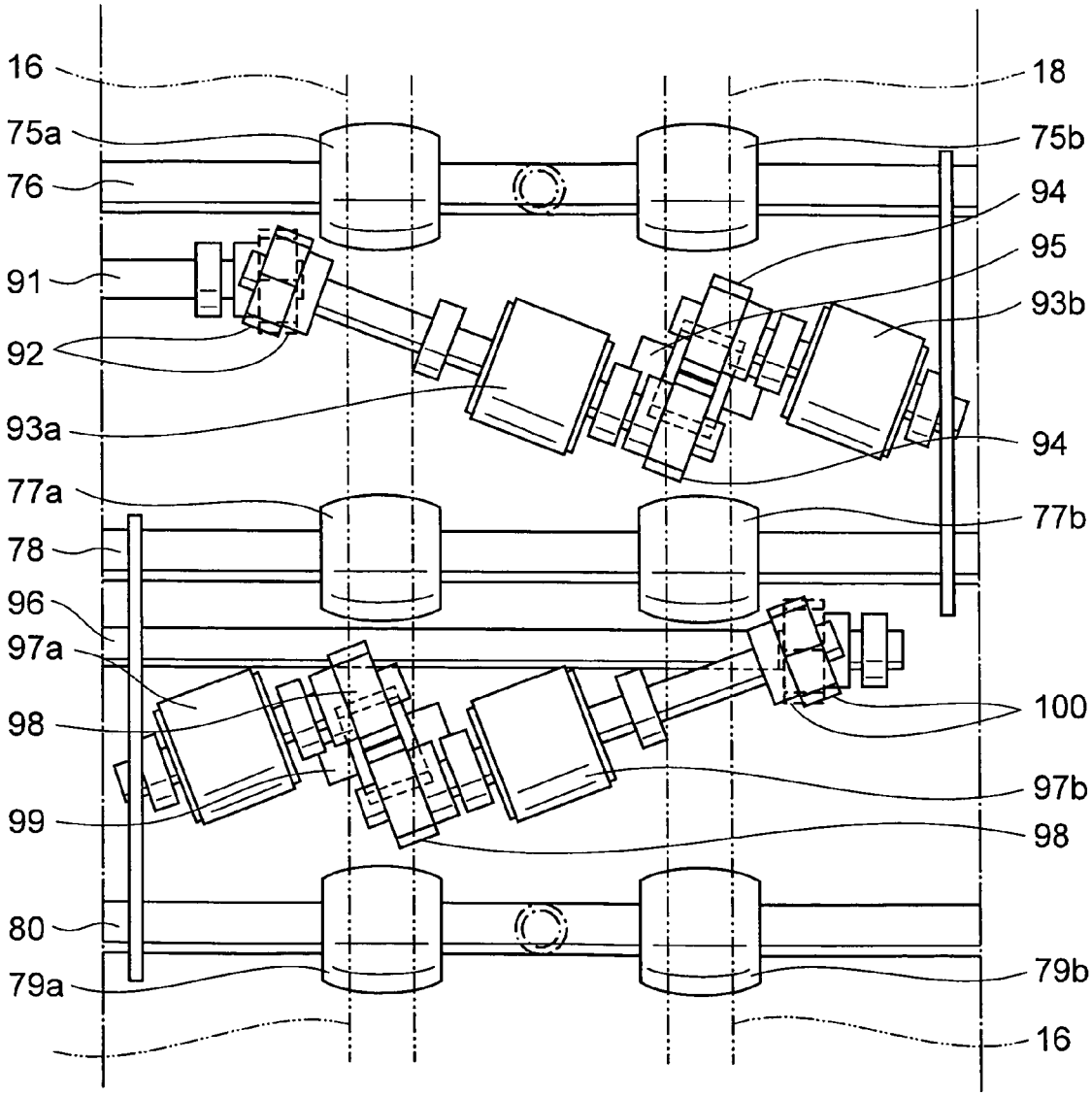
FIG. 3 is a partially enlarged, plan view of the lower mechanism of the paper notes shift apparatus.

A lower mechanism of the paper note shift apparatus 1 comprises, as shown in FIG. 2, two left and right conveyance belts 16, 18 disposed in a lower region. The conveyance belts 16, 18 are stretched round rollers 71 (71*a*, 71*b*), 73, 75 (75*a*, 75*b*), 77 (77*a*, 77*b*), 79 (79*a*, 79*b*), 81, 83 (83*a*, 83*b*), 85, surfaces of which are formed from a rubber member, as shown in FIG. 4 and are structured to rotate in conveyance direction by obtaining a rotational force of a motor M4 (FIG. 13) described later.

The respective rollers are appropriately fitted rotatably onto shafts, etc. and provided to be left-right symmetric as shown in FIGS. 2 and 4. More specifically, the rollers 71*a*, 71*b* are provided on a shaft 72 as shown in FIG. 2. The rollers 75*a*, 75*b* are provided on a shaft 76. The rollers 77*a*, 77*b* are provided on a shaft 78. The rollers 79*a*, 79*b* are provided on a shaft 80. The rollers 83*a*, 83*b* are provided on a shaft 84. As shown in FIG. 4, the rollers 73, 73 are provided on a shaft 74. The rollers 81, 81 are provided on a shaft 82. The rollers 85, 85 are provided on a shaft 86.

The rollers 71, 73, 81, 83, 85 are fixed in positions so as to rotate in predetermined positions. By inclining the shafts 76, 78, 80 connected to a connection guide 122 in a manner described later, the rollers 75, 77, 79 may be simultaneously changed by the same distance in level by and caused to function as vertical movement rollers. As shown in FIG. 4, the rollers 75, 77, 79 are provided in parallel to one another so as to become the same in level.

While the rollers 75, 77, 79 in three rows are provided on the connection guide 122 in the embodiment, they may be provided in other plural rows such as two rows, or four or more rows.

The lower mechanism comprises, as shown in an enlarged plan view of FIG. 2, skew conveyance rollers 93 (93*a*, 93*b*) and skew conveyance rollers 97 (97*a*, 97*b*), surfaces of which are formed from a rubber member.

The skew conveyance rollers 93*a*, 93*b* are juxtaposed with each other left and right of the conveyance belt 18, and gears 94, 94 fitted onto respective rotating shafts are connected together through a gear 95. A rotating shaft 91 is connected to the rotating shaft of the left skew conveyance roller 93*a* through crossed helical gears 92, 92. Thereby, receiving a rotational force of a motor M1 (FIG. 13), described later, connected to the rotating shaft 91, the skew conveyance rollers 93*a*, 93*b* are drivenly rotated simultaneously at the same speed in the same direction.

The skew conveyance rollers 93*a*, 93*b* are set to be larger in rotating speed than the conveyance belts 15, 16, 17, 18 to shift paper notes in conveyance so as to pull out the paper notes.

The skew conveyance rollers 97*a*, 97*b* are juxtaposed with each other left and right of the conveyance belt 16, and gears 98, 98 fitted onto respective rotating shafts are connected together through a gear 99. A rotating shaft 96 is connected to the rotating shaft of the right skew conveyance roller 97*b* through crossed helical gears 100, 100. Thereby, receiving a rotational force of a motor M2 (FIG. 13), described later, connected to the rotating shaft 96, the skew conveyance rollers 97*a*, 97*b* are drivenly rotated simultaneously at the same speed in the same direction.

The skew conveyance rollers 97*a*, 97*b* are set to be larger in rotating speed than the conveyance belts 15, 16, 17, 18 to shift paper notes in conveyance so as to pull out the paper notes.

Figure 5:
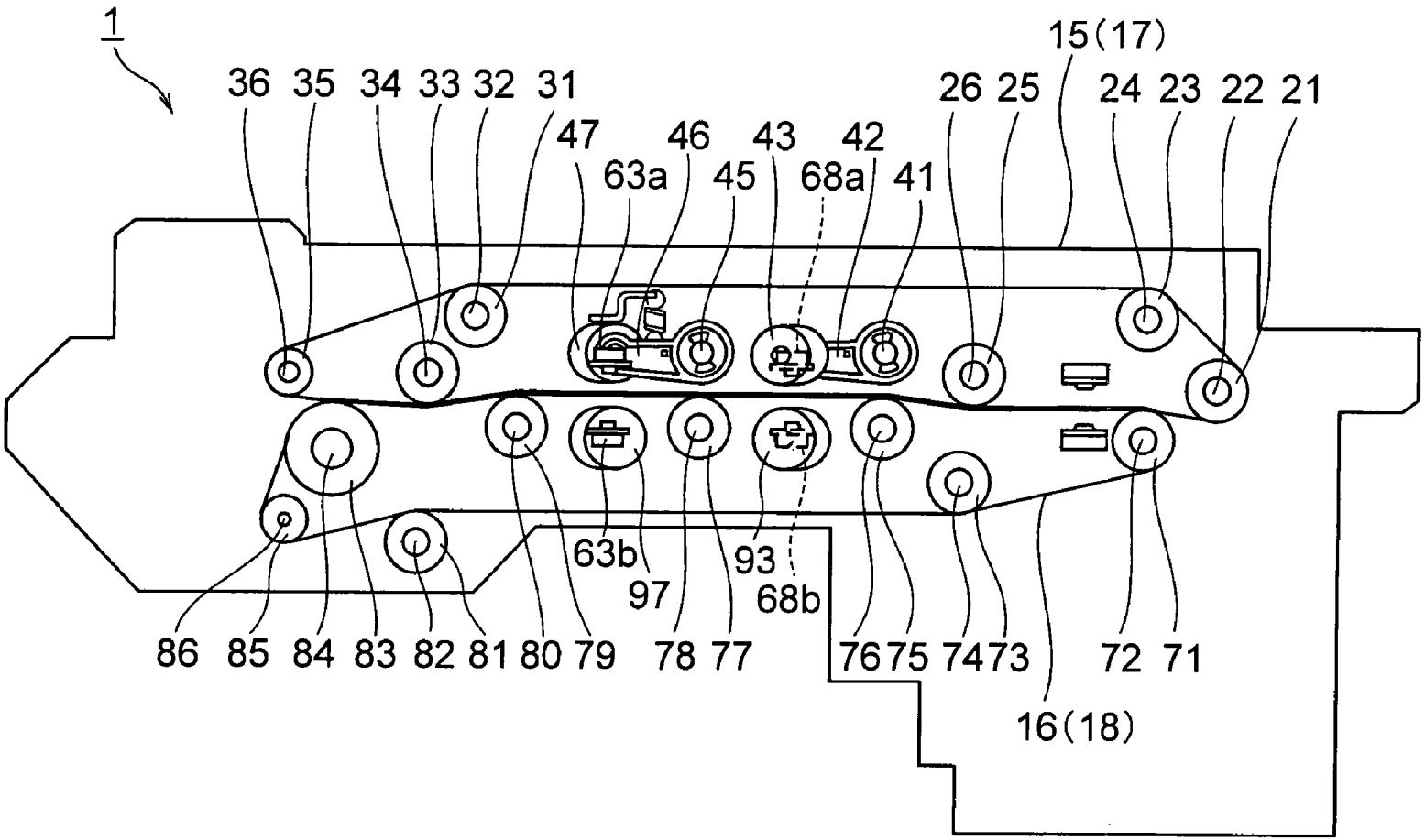
FIG. 5 is a right side cross sectional view of a shift mechanism of the paper notes shift apparatus.

The skew conveyance rollers 93 are positioned below and in opposition to the skew execution rollers 43 as shown in FIG. 5.

Likewise, the skew conveyance rollers 97 are positioned below and in opposition to the skew execution rollers 47.

In addition, the skew execution rollers 43, 47 and the skew conveyance rollers 93, 97 are structured so that a frictional force generated between the rollers and paper notes in conveyance is larger than a frictional force generated between the conveyance belts 15, 17 and the conveyance belts 16, 18 and paper notes.

Such structure is preferably realized by using materials having a higher coefficient of friction than that of the conveyance belts 15, 16, 17, 18, for surface materials of the skew execution rollers 43, 47 and the skew conveyance rollers 93, 97, or making a pushing force, with which the skew execution rollers 43, 47 and the skew conveyance rollers 93, 97 pinch paper notes, larger than a pushing force, with which the conveyance belts 15, 16, 17, 18 pinch paper notes, or enhancing the coefficient of friction and increasing the pushing force.

In a lower position of the lower mechanism in the conveyance path, a paper note interval detection phototransistor 11*b*, a skew detection phototransistor 12*b*, shift execution light-receiving units (61*b*, 62*b*, 66*b*, 67*b*), and leftward-shift termination phototransistor groups 68*b*, 63*b* are provided in this order and in the order from a taking-in side (an upper side in FIG. 2) of paper notes as shown in FIG. 2.

The shift execution light-receiving units comprises a rightward-shift start phototransistor group 61*b* and a leftward-shift start phototransistor group 66*b*, which are provided left-right symmetric in the vicinity of side walls of the conveyance path, and a leftward-shift stop phototransistor group 62*b* and a rightward-shift stop phototransistor group 67*b*, which are provided left-right symmetric inside of the rightward-shift start phototransistor group and the leftward-shift start phototransistor group, and these phototransistor groups are arranged in a lateral row.

The rightward-shift start phototransistor group 61*b* and the leftward-shift stop phototransistor group 62*b* are paired and provided on the left of the conveyance path, and the rightward-shift stop phototransistor group 67*b* and the leftward-shift start phototransistor group 66*b* are paired and provided on the right of the conveyance path.

All the rightward-shift start phototransistor group 61*b*, the leftward-shift stop phototransistor group 62*b*, the leftward-shift start phototransistor group 66*b*, and the rightward-shift stop phototransistor group 67*b* are formed by juxtaposing three phototransistors laterally.

The leftward-shift termination phototransistor group 68*b* is arranged in a position on the lateral and right side of the skew conveyance rollers 93 and formed by juxtaposing three phototransistors laterally in those positions, which are the same in the conveyance widthwise direction as those of the leftward-shift start phototransistor group 66*b*.

The rightward-shift termination phototransistor group 63*b* is arranged in a position on the lateral and left side of the skew conveyance rollers 97 and formed by juxtaposing three phototransistors laterally in those positions, which are the same in the conveyance widthwise direction as those of the rightward-shift start phototransistor group 61*b*.

With such construction, it is possible to sandwich sheets between the conveyance belt 15 and the conveyance belt 16 and between the conveyance belt 17 and the conveyance belt 18 to convey the same. At this time, since tops of the rollers 75, 77, 79 are a little higher in level than bottom surfaces of the rollers 27, 29 as shown in FIG. 4, the conveyance belts 15, 17 and the conveyance belts 16, 18 wave a little in a contact state to provide for sufficient pushing forces on contact portions.

Accordingly, it is possible to firmly pinch paper notes being conveyed to stably convey the same at a high speed such that paper notes being conveyed are not seen by eyesight of an ordinary person and afterimage may be recognized with difficulty.

Since the skew execution rollers 43, 47 may be moved up and down, either the skew execution roller 43 or the skew execution roller 47 may be moved downward to be pushed against the opposite skew conveyance rollers 93 or the opposite skew conveyance rollers 97 to bias the same when paper notes being conveyed are to be skewed to be shifted laterally.

Thereby, the skew execution rollers 43, 47 and the skew conveyance rollers 93, 97, which are larger in frictional force than the conveyance belts 15, 16, 17, 18, pinch paper notes to skew and convey the same, thus enabling displacing the paper notes laterally.

In addition, distances between the rollers 25, 77, 29, 79, 33 are preferably set to be shorter than a length (that is, a length of short sides of paper notes) of a minimum paper notes being conveyed, in the direction of conveyance, or set to distances nearly the length.

Subsequently, the construction of belt inclining drive units 90, which switch the shafts 76, 78, 80 between a horizontal state and an oblique state to vary paper note holding forces of the conveyance belts 15, 16, 17, 18, will be described with reference to right side views of FIGS. 6 and 7 and a front view of FIG. 8.

Figure 6:
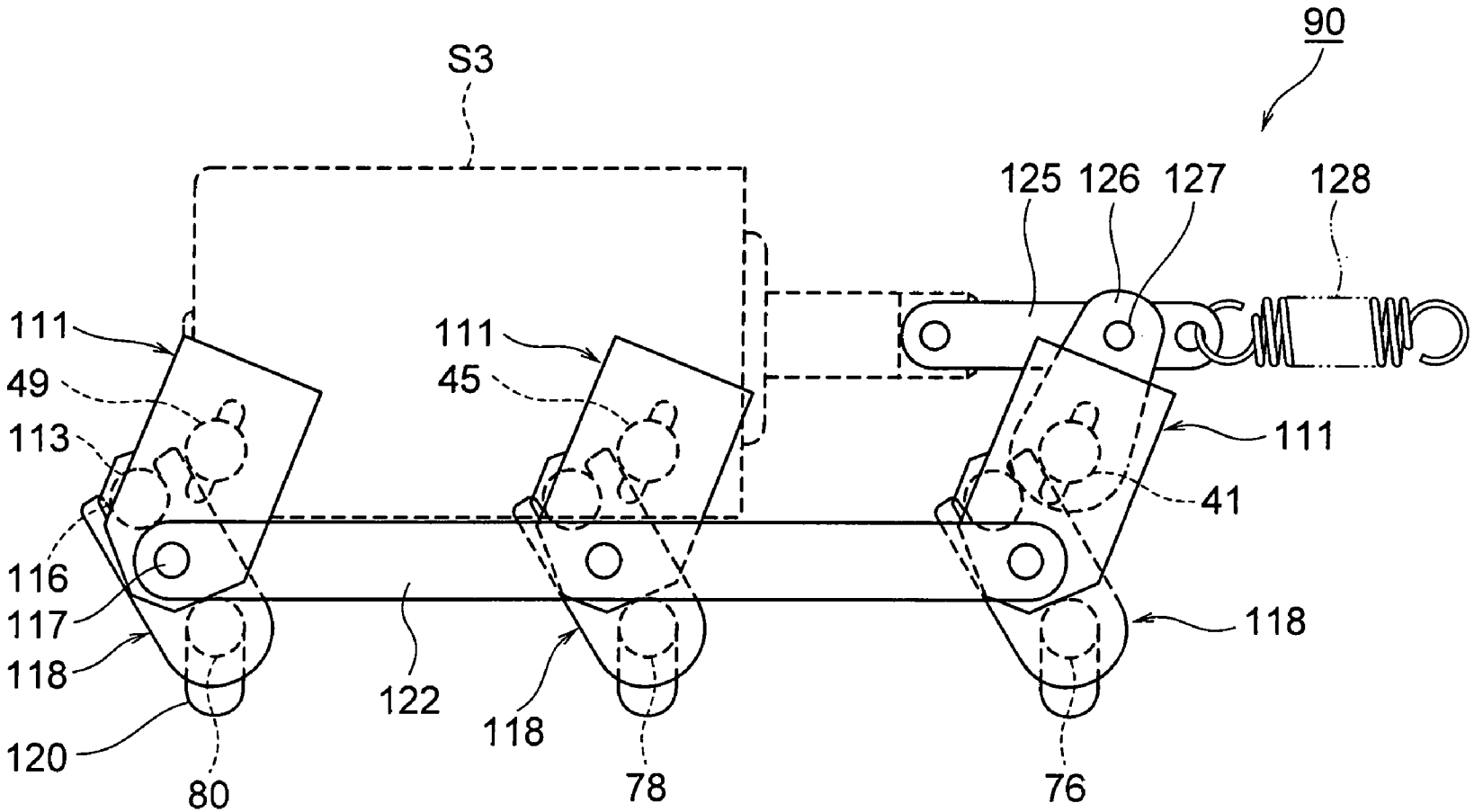
FIG. 6 is a right side view of a belt inclining drive unit.

FIG. 6 shows a configuration of the belt inclining drive unit 90 provided on the right of the paper note shift apparatus 1 in a shift non-execution state, in which the respective shafts 76,

78, 80 are inserted through longitudinal holes 120 to be restricted left and right and to be able to move up and down, and have ends thereof mounted to lower portions of drive plates 118.

Pivot shafts 117 are mounted centrally of the drive plates 118, and the pivot shafts 117 are pivotally mounted to the connection guide 122.

The drive plates 118 are provided on upper portions thereof with U-shaped grooves 116, and pivot shafts 113 provided on leftward lower portions of drive plates 111 engage with the grooves 116.

Lower portions of the drive plates 111 are pivotally mounted to the pivot shafts 117, and upper portions of the drive plates 111 permit the shafts 41, 45, 49 (FIGS. 1 and 6) to extend therethrough.

The drive plate 111 mounting thereto the shaft 41 is fixedly connected at an upper portion thereof to a solenoid connection plate 126.

A connection plate 125 for connection of a solenoid S3 to a coiled spring 128 is connected through a pivot 127 to an upper portion of the solenoid connection plate 126.

With such construction, while power supply for the solenoid S3 is made OFF, an elastic force of the coiled spring 128 causes the solenoid connection plate 126 and the drive plate 111 to turn a little to positions clockwise in the figure with the respective shafts 41, 45, 49 as pivots to stop there. Accordingly, the drive plates 118 turn a little to positions counterclockwise to stop there, and the shafts 76, 78, 80 stop in upper positions.

Figure 7:
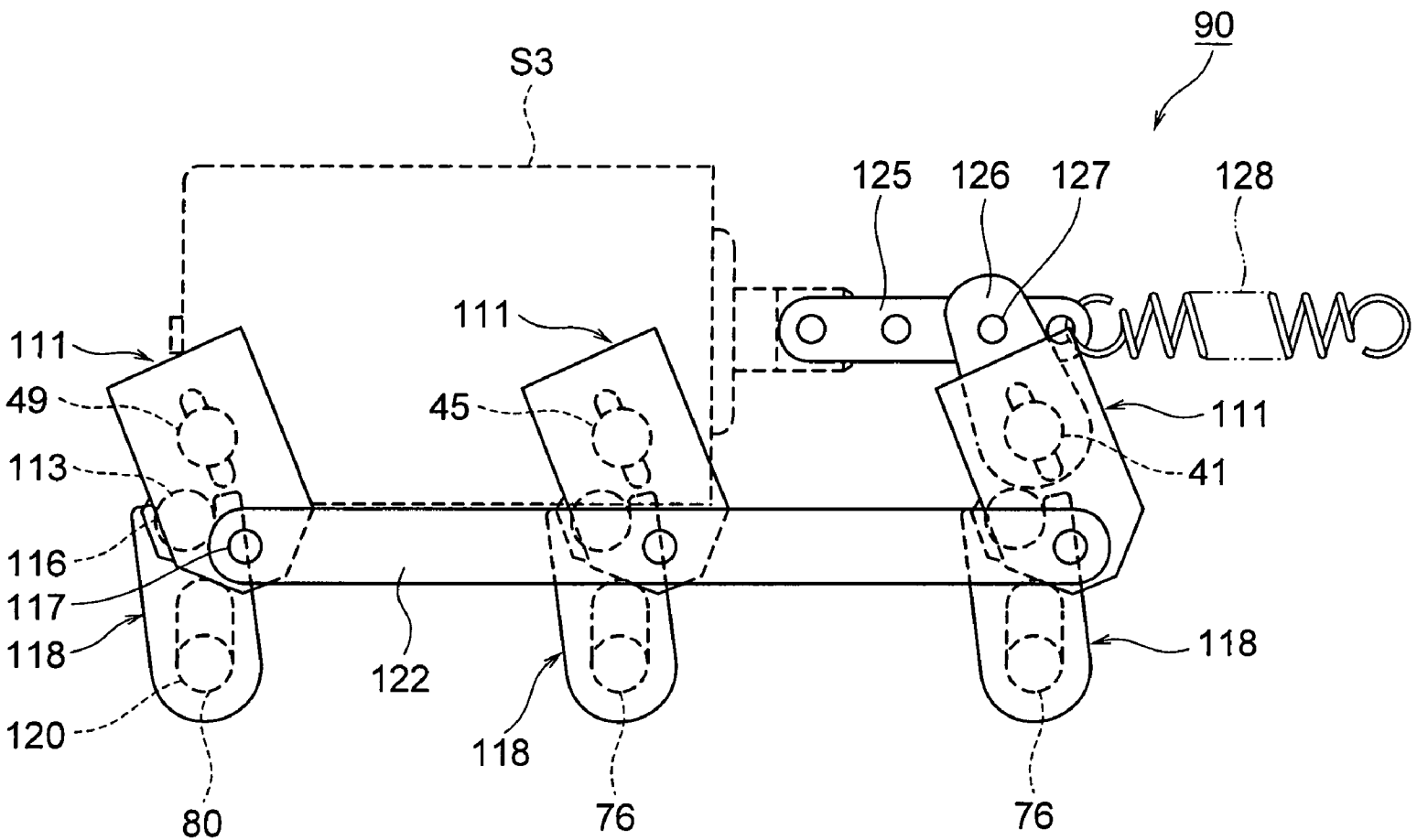
FIG. 7 is a right side view of the belt inclining drive unit.

When power supply for the solenoid S3 is made ON, the solenoid connection plate 126 and the drive plate 111 turn a little counterclockwise with the respective shafts 41, 45, 49 as pivots in a shift execution state of the belt inclining drive unit 90 shown in FIG. 7. Accordingly, the drive plates 118 turn a little clockwise, and the shafts 76, 78, 80 stop in lower positions.

The belt inclining drive units 90 are provided left-right symmetric on both ends of the shafts 76, 78, 80. Accordingly, in a normal conveyance state, the both belt inclining drive units 90 perform conveyance of paper notes with the shafts 76, 78, 80 in upper positions.

Figure 8:
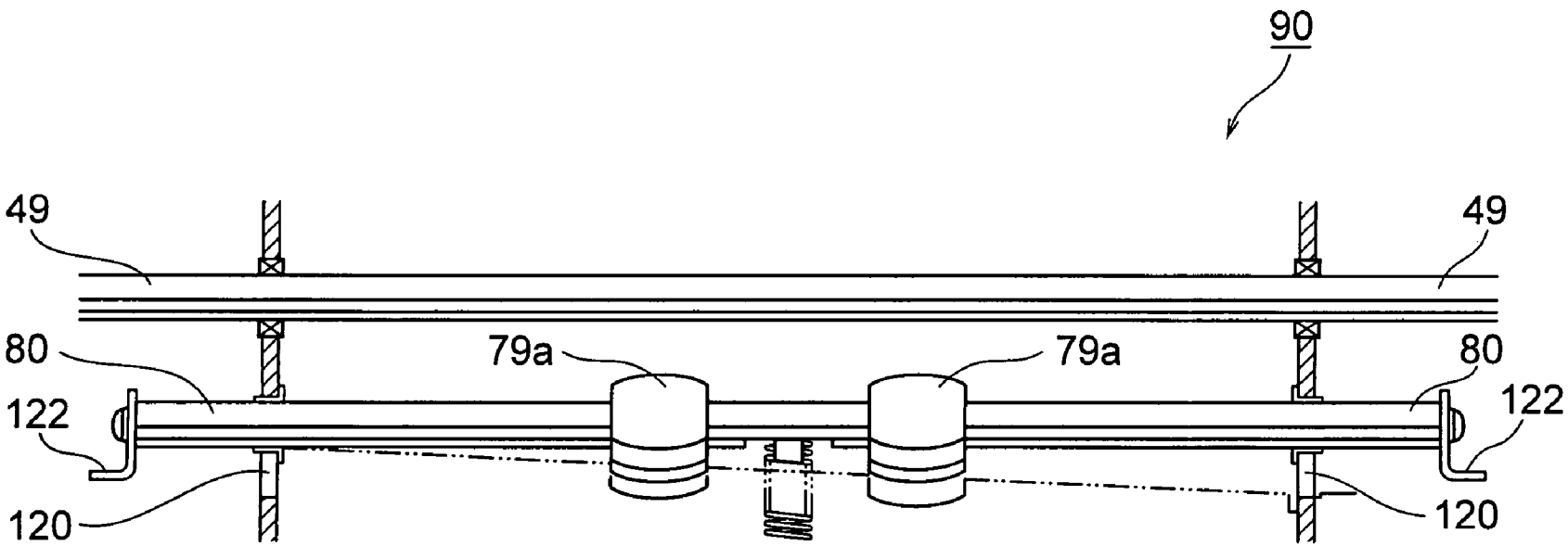
FIG. 8 is a front view of the belt inclining drive unit.

When performing shift, power supply for the solenoid of one of the belt inclining drive units 90 is made ON to move one ends of the shafts 76, 78, 80 downward as shown in a front view of FIG. 8 to put the shafts 76, 78, 80 in an oblique state.

Thereby, the rollers 75*b*, 77*b*, 79*b* (FIG. 2), which are provided on the side moved downwardly (a right side in the figure) among the rollers 75, 77, 79 provided on the shafts 76, 78, 80 descend, so that the conveyance belts stretched thereround also descend downward.

Figure 9A:
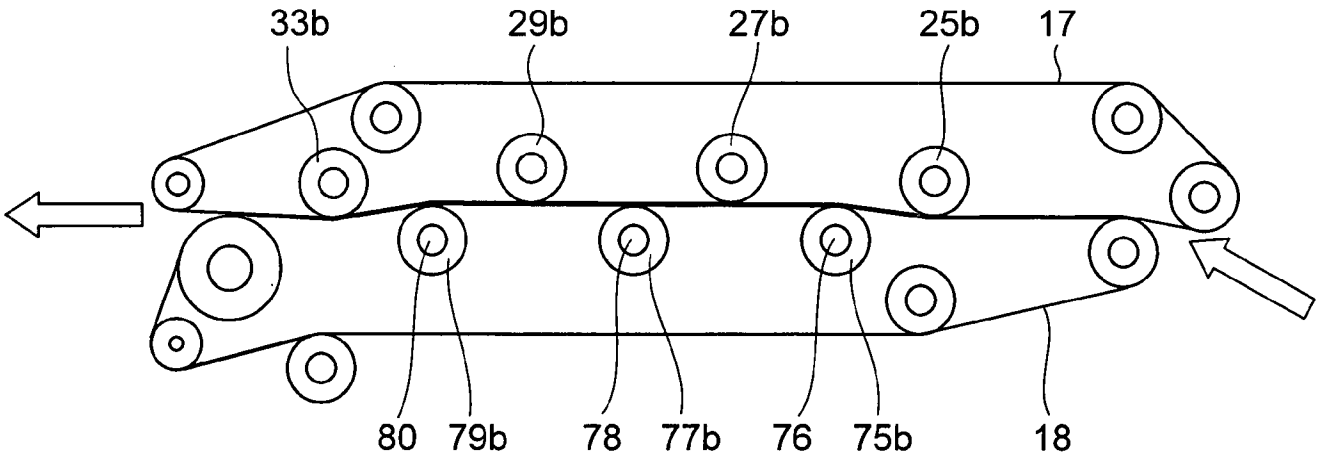
FIGS. 9A and 9B are right side views illustrating a change in a pushing force of a conveyance belt.

Specifically, in a normal state, in which both ends of the shafts 76, 78, 80 are moved upward, those portions of the conveyance belts 17, 18, which are stretched round the rollers 25*b*, 27*b*, 29*b* and the rollers 75*b*, 77*b*, 79*b*, are put in a state of being waved by these rollers as shown in a right side view of FIG. 9A.

Figure 10A:
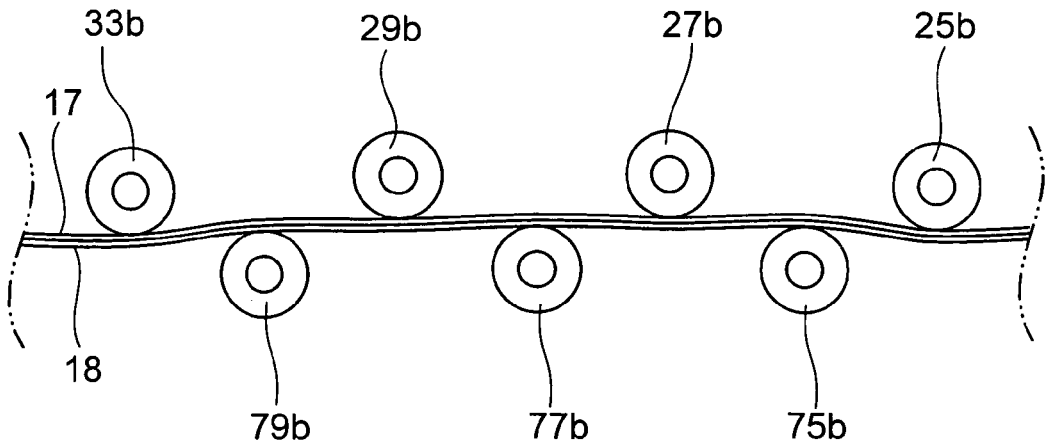
FIGS. 10A and 10B are enlarged, right side views illustrating a change in a pushing force of the conveyance belt.

More specifically, in this state, uppermost portions of the rollers 75*b*, 77*b*, 79*b* are positioned above those positions, which are lowered thicknesses of the conveyance belts 17, 18 relative to lowermost portions of the rollers 25*b*, 27*b*, 29*b*, as shown in an enlarged right side view of FIG. 10A.

Therefore, the conveyance belts 17, 18 are a little curved by the rollers 25*b*, 27*b*, 29*b* and the rollers 75*b*, 77*b*, 79*b* and the conveyance belts 17, 18 apply tension on the curved portions to firmly pinch paper notes to enable pushing and conveying the same.

Figure 9B:
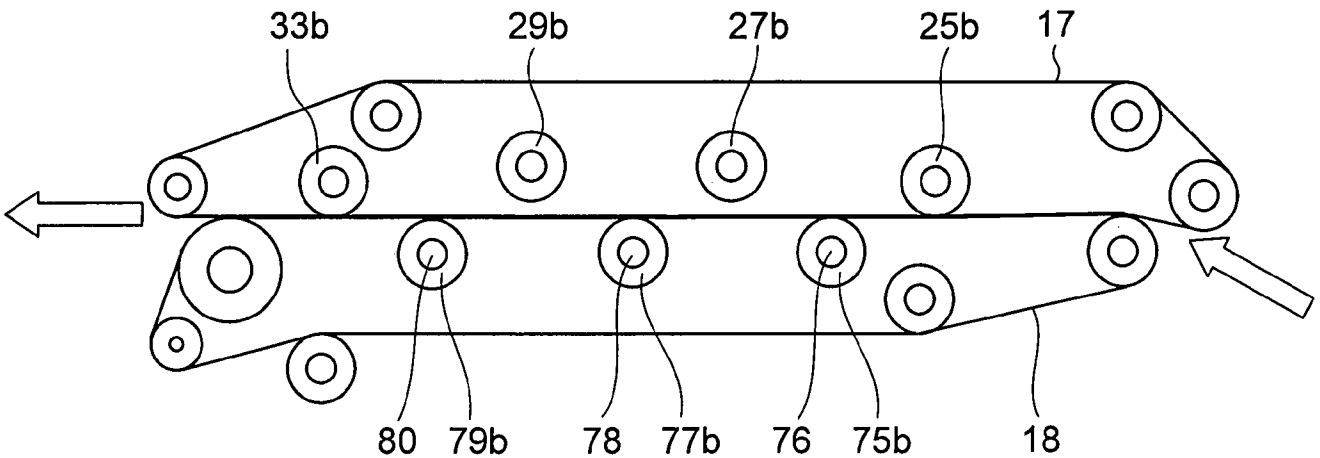

When one ends of the shafts 76, 78, 80, that is, right ends in this example are moved downward from this state in a manner described above, the rollers 75*b*, 77*b*, 79*b* on the right side descend downward to put the conveyance belts 17, 18 between the rollers 25*b*, 33*b* in a straight state as shown in the right side view of FIG. 9B.

Figure 10B:
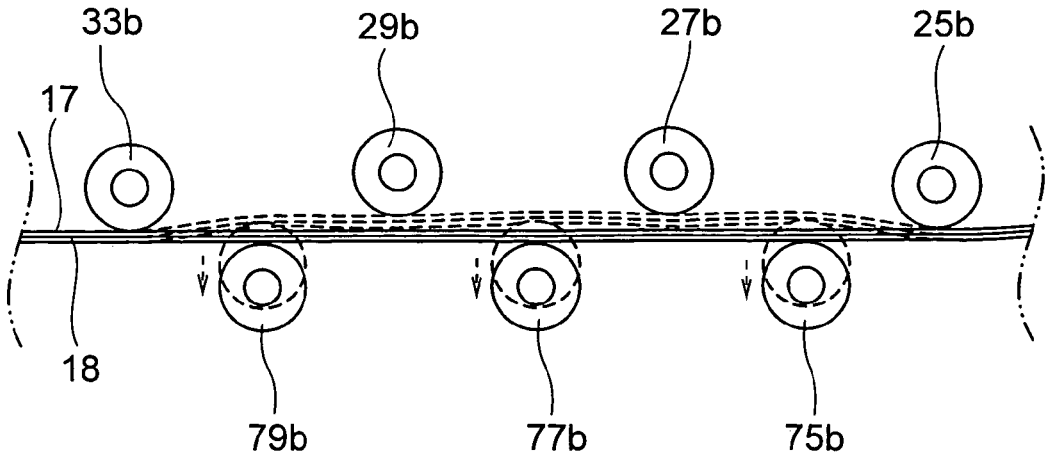

That is, in this state, uppermost portions of the rollers 75*b*, 77*b*, 79*b* are positioned below those positions, which are lowered thicknesses of the conveyance belts 17, 18 relative to lowermost portions of the rollers 25*b*, 27*b*, 29*b*, as shown in an enlarged, right side view of FIG. 10B.

Therefore, the conveyance belts 17, 18 between the rollers 25*b*, 33*b* are in contact with each other but are free of those portions, which are curved by the rollers, in intermediate portions and free of those portions, on which the conveyance belts 17, 18 apply tension strongly. Accordingly, a sheet interposed by the conveyance belts 17, 18 is put in a state, in which a small force enables the sheet to move freely in a horizontal direction, between the rollers 25*b*, 33*b*.

In this manner, the belt inclining drive units 90 provided on both left and right side of the paper note shift apparatus 1 may switch the shafts 76, 78, 80 in three states, that is, a horizontal state in upper positions, a rightwardly and downwardly oblique state, and a leftwardly and downwardly oblique state.

In addition, arrows in FIGS. 9A and 9B indicate a direction, in which paper notes are conveyed. Depiction of the rollers 75*a*, 77*a*, 79*a* on the left side and the conveyance belts 15, 16 on the left side is omitted.

With such construction, when paper notes are to be conveyed, the conveyance belts 15, 16, 17, 18 may convey paper notes stably. When paper notes are to be shifted, the shafts 76, 78, 80 may be inclined to achieve downward movements of either of the rollers 75*a*, 77*a*, 79*a* and the rollers 75*b*, 77*b*, 79*b*, which are movable up and down. Thereby, pushing forces of either of the conveyance belts 15, 16 and the conveyance belts 17, 18 are lessened to enable eliminating obstruction of shift.

The rollers 75*a*, 77*a*, 79*a* or the rollers 75*b*, 77*b*, 79*b*, which are not moved downward, are also moved slightly downward due to inclination of the shafts 76, 78, 80. Since the conveyance belts. 15, 16 or the conveyance belts 17, 18 are still maintained in a waved state, however, a sufficient pushing force for conveyance is provided although being a little weaker than that in a normal state, so that it is possible to convey paper notes. At this time, while a force for conveyance is provided, a pushing force becomes slightly small, thereby making shift easy.

Subsequently, the structure of the skew execution rollers 43, 47 for positional shift of paper notes will be described with reference to illustrations of FIGS. 11A, 11B, and 11C.

Figure 11A:
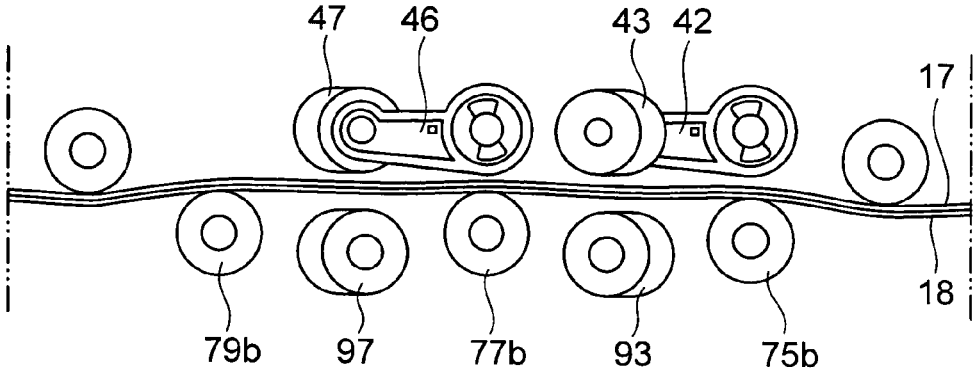
FIGS. 11A, 11B, and 11C are enlarged, right side views illustrating motions of skew execution rollers.

In a normal state of conveyance, the arms 42, 46 are put in a horizontal state to lift the skew execution rollers 43, 47 to upper position as shown in an enlarged, right side view of FIG. 11A. By making power supply for the solenoids S1, S2 (FIG. 1) OFF, elastic forces of appropriate springs realize such lift.

Figure 11B:
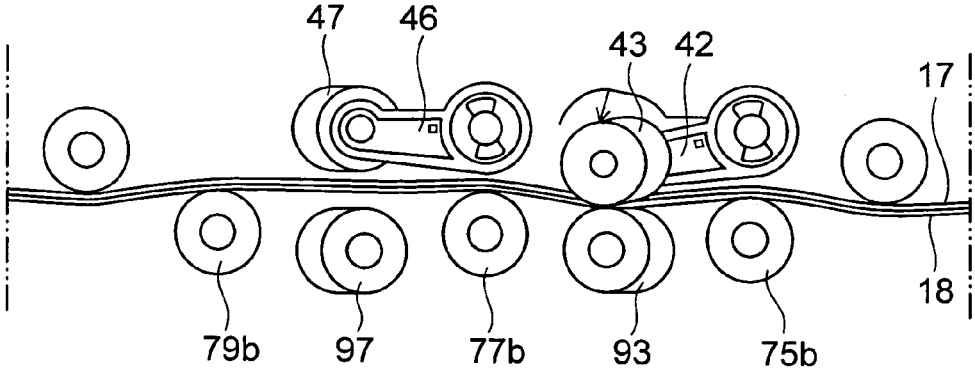

When paper notes on the right side are to be put to the center, the skew execution roller 43 interposing therebetween the right conveyance belts 17, 18 is lowered to a lower position as shown in FIG. 11B. This motion is executed by making power supply for the solenoid S2 (FIG. 1) ON and turning the arm 42 a little.

At this time, the shafts 76, 78, 80 described above are inclined leftwardly downward, the conveyance belts 17, 18 shown in the figure are put in substantially the same waved state as that in a normal state of conveyance, and the conveyance belts 15, 16, illustration of which is omitted, are put in a horizontal state.

Figure 11C:
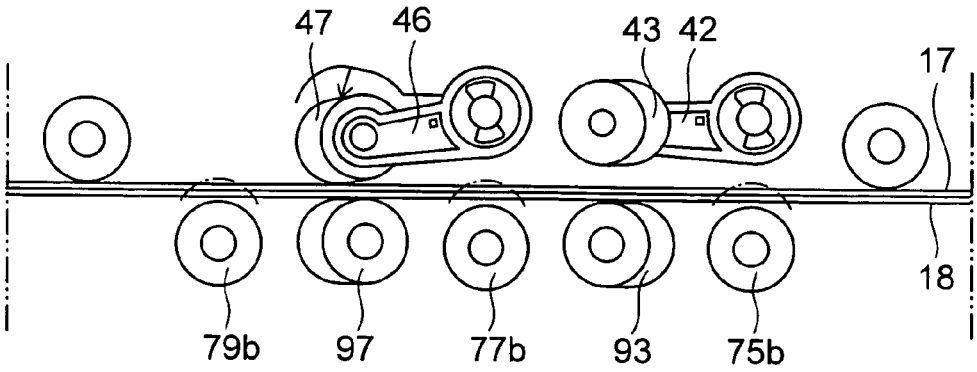

When paper notes on the left side are to be put to the center, the skew execution roller 47 interposing therebetween the left conveyance belts 15, 16 is lowered to a lower position as shown in FIG. 11C. This motion is executed by making power supply for the solenoid S1 (FIG. 1) ON and turning the arm 46 a little.

At this time, the shafts 76, 78, 80 described above are inclined rightwardly downward, the conveyance belts 17, 18 shown in the figure are put in a horizontal state, and the conveyance belts 15, 16, illustration of which is omitted, are put in substantially the same waved state as that in a normal state of conveyance.

The construction described above makes it possible to put small paper notes, disposed on the left or right side, to the center to properly store the same in a small-sized cassette.

Figure 12:
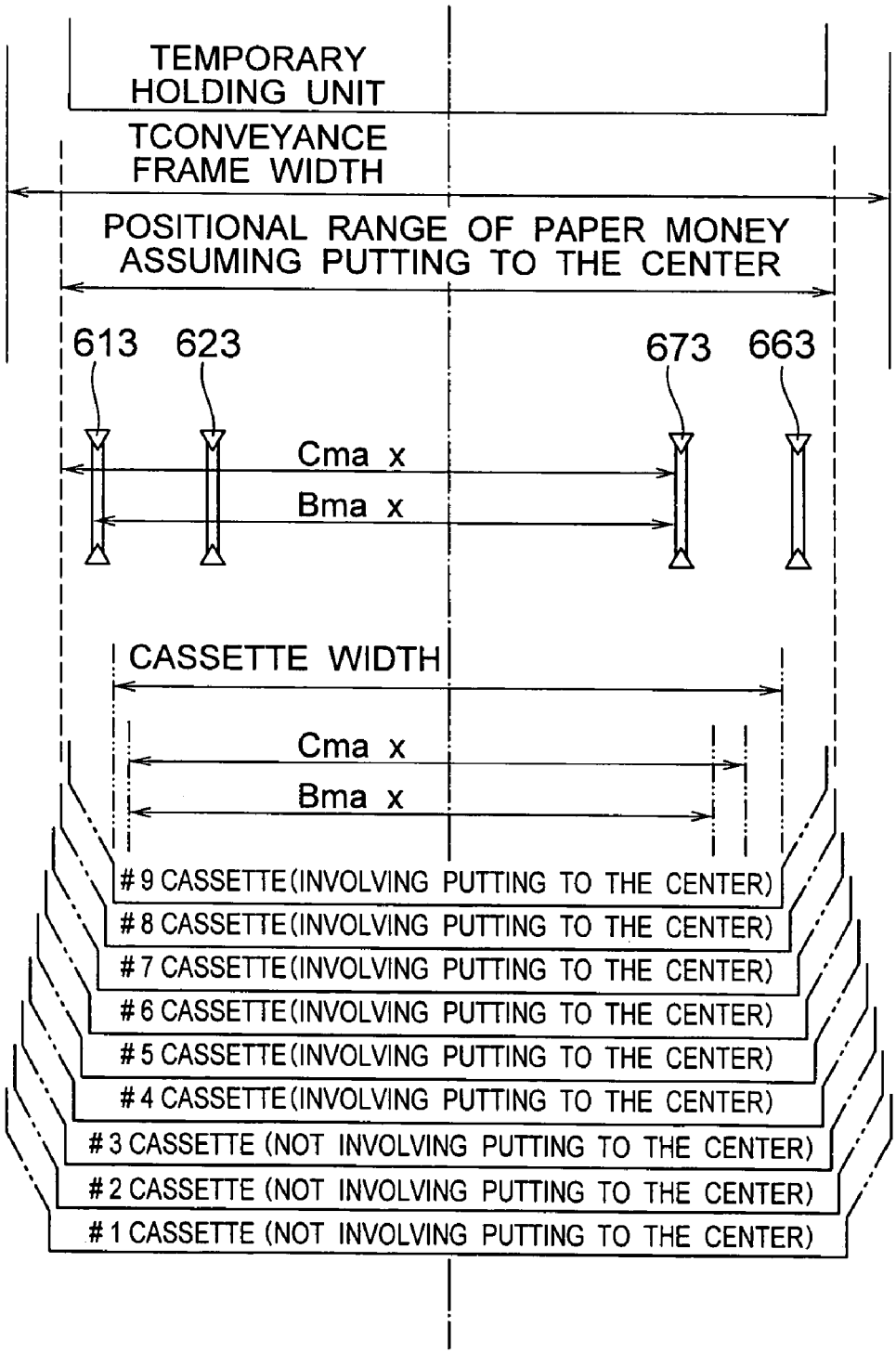
FIG. 12 is a view illustrating the relationship between positions of sensors and cassette sizes.

Subsequently, the relationship between positions of the sensors and cassette sizes will be described with reference to an illustration shown in FIG. 12.

The figure illustrates the relationship between a #9 cassette having a minimum size and a #8 cassette having a next small size, and a small-size rightward-shift start sensor 613, a small-size leftward-shift stop sensor 623, a small-size rightward-shift stop sensor 673, and a small-size leftward-shift start sensor 663.

The small-size rightward-shift start sensor 613 is constituted by a right-end LED out of the three laterally-juxtaposed LEDs as the rightward-shift start LED group 61*a* (FIG. 1), and a right-end phototransistor out of the three laterally-juxtaposed phototransistors as the rightward-shift start phototransistor group 61*b* (FIG. 2).

The small-size leftward-shift stop sensor 623 is constituted by a right-end LED out of three laterally-juxtaposed LEDs as the leftward-shift stop LED group 62*a* (FIG. 1), and a right-end phototransistor out of three laterally-juxtaposed phototransistors as the leftward-shift stop phototransistor group 62*b* (FIG. 2).

The small-size rightward-shift stop sensor 673 is constituted by a right-end LED out of three laterally-juxtaposed LEDs as the rightward-shift stop LED group 67*a* (FIG. 1), and a right-end phototransistor out of three laterally-juxtaposed phototransistors as the rightward-shift stop phototransistor group 67*b* (FIG. 2).

The small-size leftward-shift start sensor 663 is a right-end LED out of three laterally-juxtaposed LEDs as the leftward-shift start LED group 66*a* (FIG. 1), and a right-end phototransistor out of three laterally-juxtaposed phototransistors as the leftward-shift start phototransistor group 66*b* (FIG. 2).

Cmax indicates a distance from a left end of a positional range of paper notes, which are supposed to be put to the center, to the small-size rightward-shift stop sensor 673 (the same as a distance from a right end of the positional range of paper notes to the small-size leftward-shift stop sensor 623), and Cmax is set to be a little smaller than the width of the #9 cassette.

In addition, the positional range of paper notes are set to be the same as, or a little larger than the width of a paper note discharge port of a temporary holding unit and to be smaller than a conveyance frame width of the paper note shift apparatus 1. The reason for this is that while the conveyance frame width has a margin, paper notes discharged from the temporary holding unit are conveyed without shift and come within the positional range of paper notes.

Bmax indicates a distance from the small-size rightward-shift start sensor 613 to the small-size rightward-shift stop sensor 673 (the same as a distance from the small-size leftward-shift start sensor 663 to the small-size leftward-shift stop sensor 623), and Bmax is set to be a little smaller than Cmax.

Also, Bmax is set to be a little longer than a length of long sides of a paper note of a type, which is stored in the #8 cassette having a large size.

The small-size rightward-shift start sensor 613 and the small-size leftward-shift start sensor 663 are provided slightly outside of positions at both ends of the #8 cassette having a large size. In addition, the sensors may be provided in the same positions as those of an inner width of the #8 cassette, or slightly inside thereof to adjust a shift distance.

The small-size leftward-shift stop sensor 623 and the small-size rightward-shift stop sensor 673 are provided inside of positions at both ends of the #9 cassette having a small size.

The positional setting makes it possible to surely store paper notes in the #8 cassette and the #9 cassette, which are destinations of storage, by the use of the small-size rightward-shift start sensor 613, the small-size leftward-shift stop sensor 623, the small-size rightward-shift stop sensor 673, and the small-size leftward-shift start sensor 663.

That is, when the small-size rightward-shift start sensor 613 is made ON, the small-size leftward-shift stop sensor 623 is made ON, the small-size rightward-shift stop sensor 673 is made OFF, and the small-size leftward-shift start sensor 663 is made OFF, paper notes are found to have a size stored in the #8 cassette or the #9 cassette and may be put to the right to be put to the center.

Likewise, when the small-size leftward-shift start sensor 663 is made ON, the small-size rightward-shift stop sensor 673 is made ON, the small-size leftward-shift stop sensor 623 is made OFF, and the small-size rightward-shift start sensor 613 is made OFF, paper notes are found to have a size stored in the #8 cassette or the #9 cassette and may be put to the left to be put to the center.

In the case where a pattern of ON/OFF states of the respective sensors is otherwise, paper notes are one needed not to be put to the center or in such state for the reason why paper notes are one having a large size, or paper notes skews, or so, and then putting paper notes to the center is not executed. Thereby, it is possible to prevent jam generated by putting paper notes in an abnormal state to the center.

Figure 13:
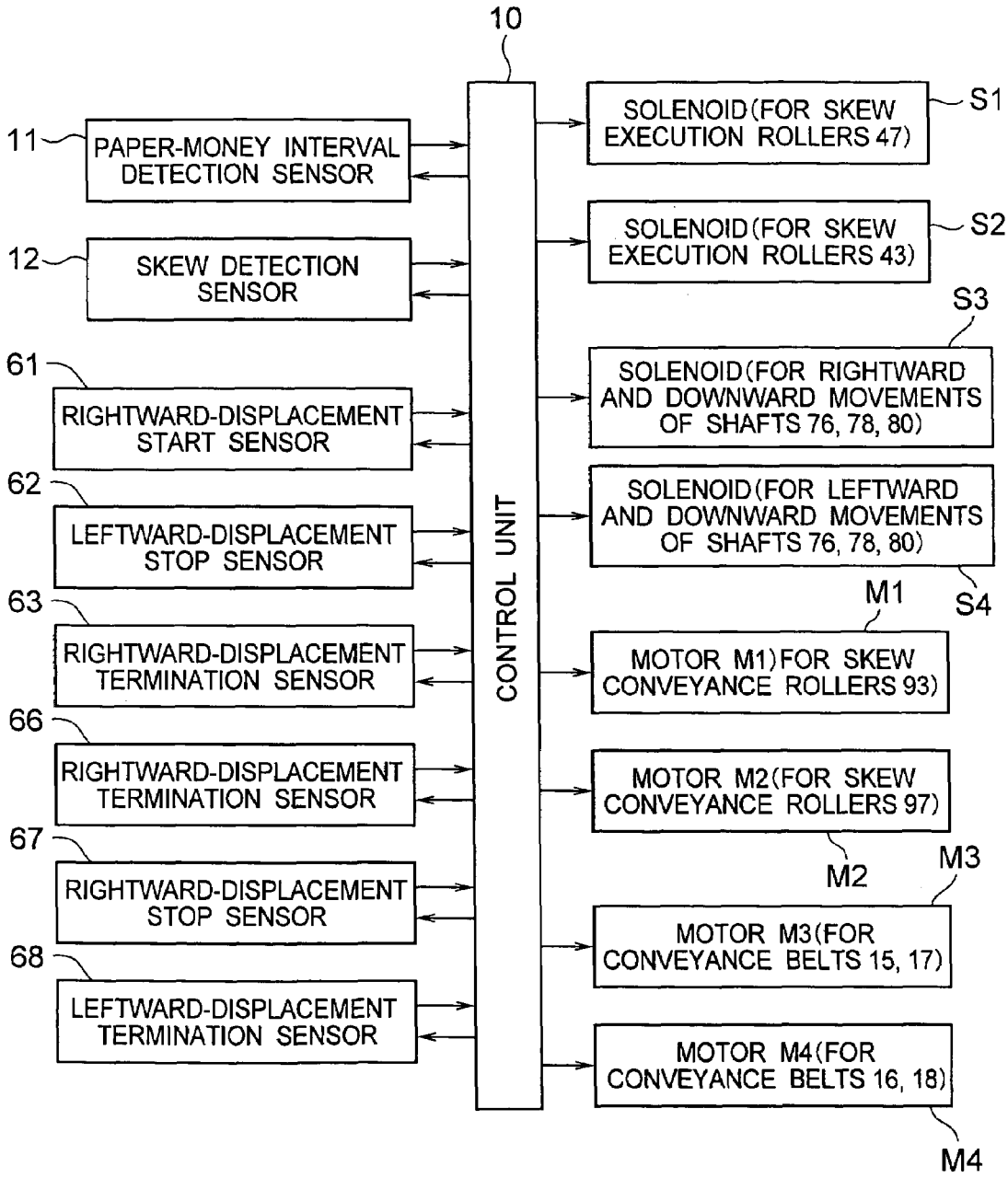
FIG. 13 is a block diagram of the paper notes shift apparatus.

Subsequently, the construction of the paper note shift apparatus 1 will be described with reference to a block diagram shown in FIG. 13.

The paper note shift apparatus 1 comprises a paper note interval detection sensor 11, a skew detection sensor 12, a rightward-shift start sensor 61, a leftward-shift stop sensor 62, a rightward-shift termination sensor 63, a leftward-shift start sensor 66, a rightward-shift stop sensor 67, a leftward-shift termination sensor 68, solenoids S1 to S4, and motors M1 to M4, and the sensors are connected to a control unit 10.

The control unit 10 comprises CPU, ROM, and RAM to execute various control operations. In the control operations, control is exercised to decrease a speed of conveyance by making a speed, at which paper notes are conveyed by the conveyance belts 15, 16, 17, 18, around seven sheets per second in the case where paper notes needed to be put to the center are not present in the temporary holding unit, and by making the speed around five sheets per second in the case where paper notes needed to be put to the center are present in the temporary holding unit.

The paper notes interval detection sensor 11 is constituted by the paper note interval detection LED11*a* (FIG. 1) and the paper note interval detection phototransistor 11*b* (FIG. 2). The paper note interval detection LED11*a* emits light in accordance with a floodlighting signal from the control unit 10, and the paper note interval detection phototransistor 11*b* detects the light to transmit a detection signal to the control unit.

The skew detection sensor 12 is constituted by the skew detection LED12*a* (FIG. 1) and the skew detection phototransistor 12*b* (FIG. 2). The skew detection LED12*a* emits light in accordance with a floodlighting signal from the control unit 10, and the skew detection phototransistor 12*b* detects the light to transmit a detection signal to the control unit.

The rightward-shift start sensor 61 comprises the rightward-shift start LED group 61*a* (FIG. 1) formed of three laterally-juxtaposed LEDs and the rightward-shift start phototransistor group 61*b* (FIG. 2) formed of three laterally-juxtaposed phototransistors.

The respective LEDs and the respective phototransistors correspond to each other one by one to constitute the small-size rightward-shift start sensor 613 (FIG. 12), a middle-size rightward-shift start sensor 612 (FIG. 16), and a large-size rightward-shift start sensor 611 (FIG. 16) in the order from inside the conveyance path.

The rightward-shift start LED group 61*a* emits light in accordance with a floodlighting signal from the control unit 10, and the rightward-shift start phototransistor group 61*b* detects the light to transmit a detection signal to the control unit.

The leftward-shift stop sensor 62 comprises the leftward-shift stop LED group 62*a* (FIG. 1) formed of three laterally-juxtaposed LEDs and the leftward-shift stop phototransistor group 62*b* (FIG. 2) formed of three laterally-juxtaposed phototransistors.

The respective LEDs and the respective phototransistors correspond to each other one by one to constitute the small-size leftward-shift stop sensor 623 (FIG. 12), a middle-size leftward-shift stop sensor 622 (FIG. 16), and a large-size leftward-shift stop sensor 621 (FIG. 16) in the order from inside the conveyance path.

The leftward-shift stop LED group 62*a* emits light in accordance with a floodlighting signal from the control unit 10, and the leftward-shift stop phototransistor group 62*b* detects the light to transmit a detection signal to the control unit.

The rightward-shift termination sensor 63 comprises the rightward-shift termination LED group 63*a* (FIG. 1) formed of three laterally-juxtaposed LEDs and the rightward-shift termination phototransistor group 63*b* (FIG. 2) formed of three laterally-juxtaposed phototransistors.

The respective LEDs and the respective phototransistors correspond to each other one by one to constitute a small-size rightward-shift termination sensor 633 (FIG. 16), a middle-size rightward-shift termination sensor 632 (FIG. 16), and a large-size rightward-shift termination sensor 631 (FIG. 16) in the order from inside the conveyance path.

The rightward-shift termination LED group 63*a* emits light in accordance with a floodlighting signal from the control unit 10, and the rightward-shift termination phototransistor group 63*b* detects the light to transmit a detection signal to the control unit.

The leftward-shift start sensor 66 comprises the leftward-shift start LED group 66*a* (FIG. 1) formed of three laterally-juxtaposed LEDs and the leftward-shift start phototransistor group 66*b* (FIG. 2) formed of three laterally-juxtaposed phototransistors.

The respective LEDs and the respective phototransistors correspond to each other one by one to constitute the small-size leftward-shift start sensor 663 (FIG. 12), a middle-size leftward-shift start sensor 662 (FIG. 16), and a large-size leftward-shift start sensor 661 (FIG. 16) in the order from inside the conveyance path.

The leftward-shift start LED group 66*a* emits light in accordance with a floodlighting signal from the control unit 10, and the leftward-shift start phototransistor group 66*b* detects the light to transmit a detection signal to the control unit.

The rightward-shift stop sensor 67 comprises the rightward-shift stop LED group 67*a* (FIG. 1) formed of three laterally-juxtaposed LEDs and the rightward-shift stop phototransistor group 67*b* (FIG. 2) formed of three laterally-juxtaposed phototransistors.

The respective LEDs and the respective phototransistors correspond to each other one by one to constitute the small-size rightward-shift stop sensor 673 (FIG. 12), a middle-size rightward-shift stop sensor 672 (FIG. 16), and a large-size leftward-shift stop sensor 671 (FIG. 16) in the order from inside the conveyance path.

The rightward-shift stop LED group 67*a* emits light in accordance with a floodlighting signal from the control unit 10, and the rightward-shift stop phototransistor group 67*b* detects the light to transmit a detection signal to the control unit.

The leftward-shift termination sensor 68 comprises the leftward-shift termination LED group 68*a* (FIG. 1) formed of three laterally-juxtaposed LEDs and the leftward-shift termination phototransistor group 68*b* (FIG. 2) formed of three laterally-juxtaposed phototransistors.

The respective LEDs and the respective phototransistors correspond to each other one by one to constitute a small-size leftward-shift termination sensor 683 (FIG. 16), a middle-size leftward-shift termination sensor 682 (FIG. 16), and a large-size leftward-shift termination sensor 681 (FIG. 16) in the order from inside the conveyance path.

The leftward-shift termination LED group 68*a* emits light in accordance with a floodlighting signal from the control unit 10, and the leftward-shift termination phototransistor group 68*b* detects the light to transmit a detection signal to the control unit.

The solenoid S1 comprises drive means that moves the skew execution roller 47 (FIGS. 11A, 11B, and 11C) up and down, and is ON/OFF driven by a drive signal from the control unit 10.

The solenoid S2 comprises drive means that moves the skew execution roller 43 (FIGS. 11A, 11B, and 11C) up and down, and is ON/OFF driven by a drive signal from the control unit 10.

The solenoid S3 comprises drive means that moves the shafts 76, 78, 80 (FIGS. 11A, 11B, and 11C) rightwardly downward, and is ON/OFF driven by a drive signal from the control unit 10.

The solenoid S4 comprises drive means that moves the shafts 76, 78, 80 (FIGS. 11A, 11B, and 11C) leftwardly downward, and is ON/OFF driven by a drive signal from the control unit 10.

The motor M1 comprises drive means that rotatingly drives the skew conveyance rollers 93 (FIG. 2), and is rotated/stopped by a drive signal from the control unit 10.

The motor M2 comprises drive means that rotatingly drives the skew conveyance rollers 97 (FIG. 2), and is rotated/stopped by a drive signal from the control unit 10.

The motor M3 comprises drive means that rotatingly drives the conveyance belts 15, 17 (FIG. 1), and is rotated/stopped by a drive signal from the control unit 10.

The motor M4 comprises drive means that rotatingly drives the conveyance belts 16, 18 (FIG. 2), and is rotated/stopped by a drive signal from the control unit 10.

With such construction, paper notes may be conveyed by the conveyance belts 15, 16, 17, 18. Also, it is possible to make judgment of necessity of putting to the center by means of the rightward-shift start sensor 61, the leftward-shift stop sensor 62, the leftward-shift start sensor 66, and the rightward-shift stop sensor 67.

Further, putting to the center may be executed by the skew execution rollers 43, 47 and the skew conveyance rollers 93, 97, and rightward lowering or leftward lowering of the shafts 76, 78, 80 may be executed so as to prevent the conveyance belts 15, 16, 17, 18 from obstructing putting to the center.

Also, the rightward-shift termination sensor 63 and the leftward-shift termination sensor 68 detect completion of positional shift of a necessary magnitude to stop positional shift, thus enabling adjusting a magnitude of shift.

Figure 14:
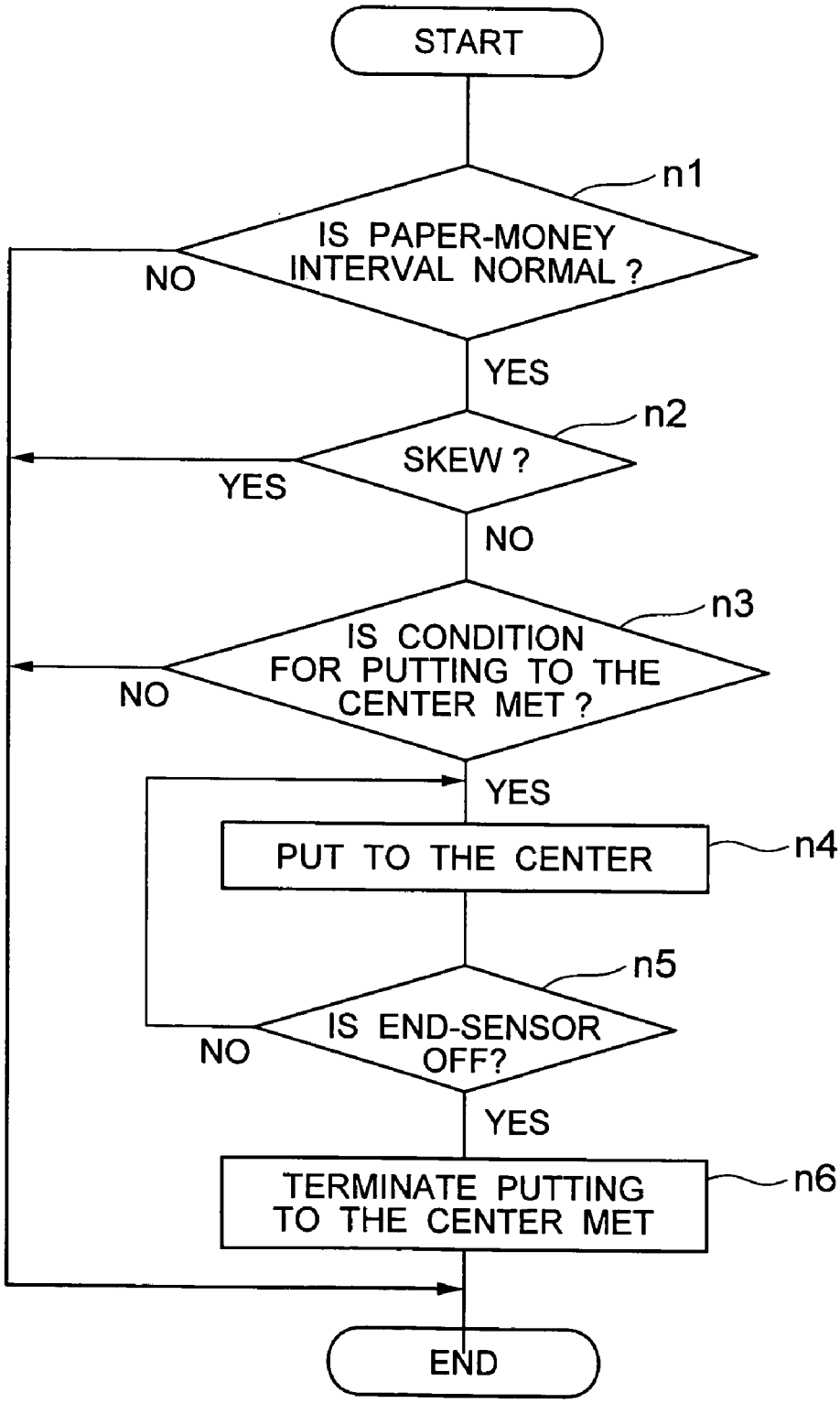
FIG. 14 a processing flow chart illustrating operations of a control unit.

Subsequently, an operation of the paper note shift apparatus 1 for shift of paper notes will be described with reference to a processing flow chart of the control unit 10 shown in FIG. 14.

The paper note interval detection sensor 11 detects whether a paper notes interval is normal, that is, whether paper notes are conveyed at a speed of conveyance corresponding to five sheets per second (STEP n1). When a paper notes interval is abnormal, paper notes are not put to the center but conveyed as they are.

When a paper notes interval is normal, the skew detection sensor 12 detects a whether a paper note being conveyed skews (STEP n2).

In the case where a paper note skews, it is not put to the center but conveyed as it is. In the case where a paper note does not skew (including the case where skew is within a tolerance), it is judged whether the condition for putting to the center is met (STEP n3).

Here, the condition for putting to the center is set to meet either of a rightward-shift condition and a leftward-shift condition.

The rightward-shift condition sets for that sensor (any one of small-size, middle-size, and large-size sensors), which corresponds to a size of a paper note being conveyed, that the rightward-shift start sensor 61 be ON and the rightward-shift stop sensor 67 be OFF.

The leftward-shift condition sets for that sensor (any one of small-size, middle-size, and large-size sensors), which corresponds to a size of a paper note being conveyed, that the leftward-shift start sensor 66 be ON and the leftward-shift stop sensor 62 be OFF.

In addition, the rightward-shift condition may set, in addition to the above condition, that the leftward-shift stop sensor 62 be ON, and/or the leftward-shift start sensor 66 be OFF.

Also, the leftward-shift condition may set, in addition to the above condition, that the rightward-shift stop sensor 67 be ON, and/or the rightward-shift start sensor 61 be OFF.

In case of setting in this manner, a state, in which a paper notes being conveyed is abnormal, may also be detected, and jam may be prevented by not executing positional shift in such abnormal state.

In the case where the condition for putting to the center is not met in STEP n3, a paper note is not put to the center but conveyed as it is. In the case where the condition for putting to the center is met, putting to the center is executed by positional shift (STEP n4).

As for putting to the center, in case of rightward shift, in which putting to the center is performed in a rightward direction from the left, power supply for the solenoid S3 is made ON to decrease pushing forces of the conveyance belts 17, 18 on the right, power supply for the solenoid S1 is made ON to move the skew execution roller 47 for rightward shift downward, and the motor M2 is rotated to rotate the skew conveyance rollers 97 for rightward shift.

In case of leftward shift, in which putting to the center is performed in a leftward direction from the right, power supply for the solenoid S4 is made ON to decrease pushing forces of the conveyance belts 15, 16 on the left, power supply for the solenoid S2 is made ON to move the skew execution roller 43 for leftward shift downward, and the motor M1 is rotated to rotate the skew conveyance rollers 93 for leftward shift.

Figure 15:
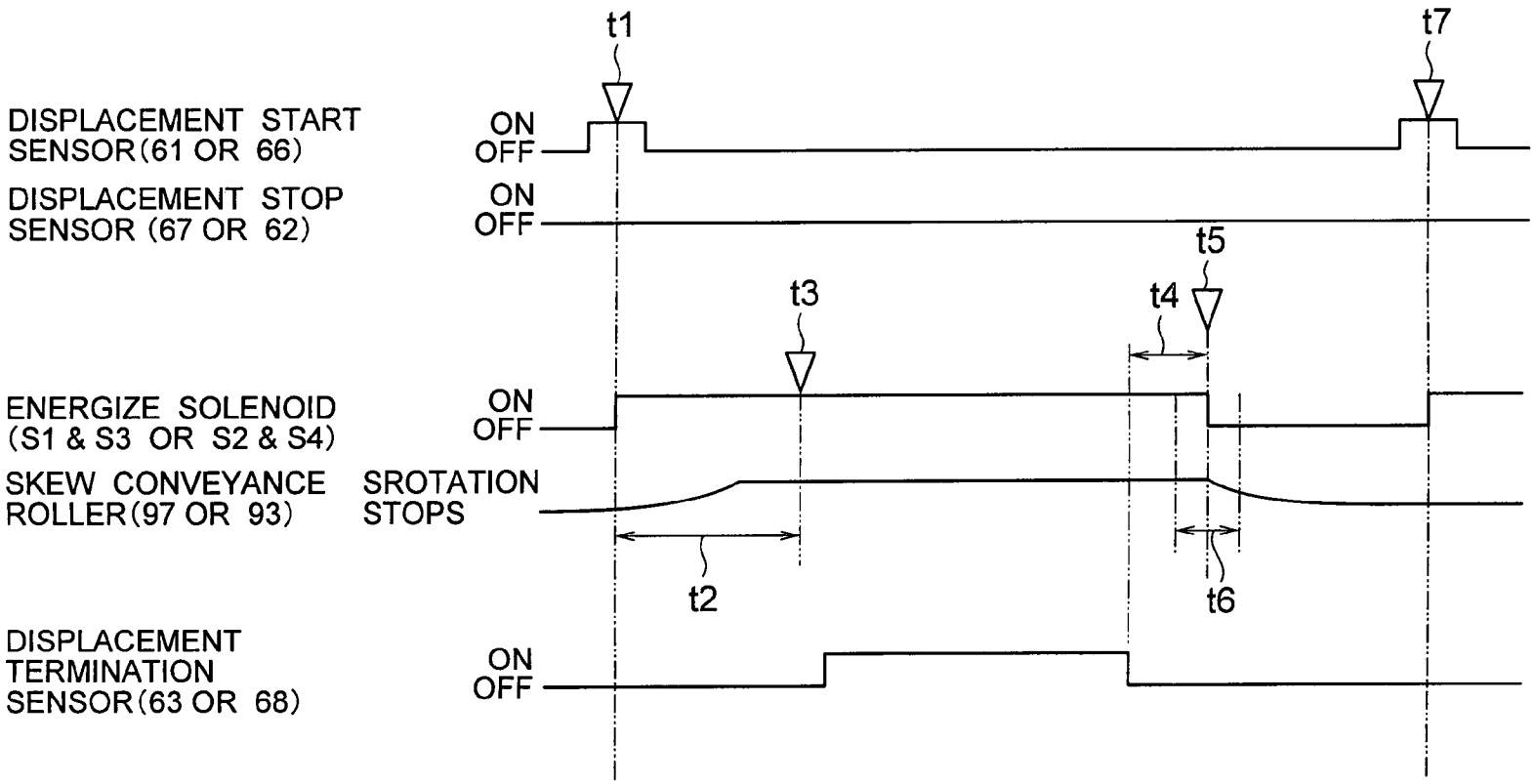
FIG. 15 is a timing chart illustrating timing of operations of the paper notes shift apparatus.

When shift is executed in this manner, movements of the solenoids are made instantly from timing t1 of judgment, in which putting to the center is decided, as shown in a timing chart of FIG. 15. Also, rotation of the skew conveyance rollers 93 or the skew conveyance rollers 97 reaches a set rotational speed (maximum speed) in a minute time. Accordingly, at an arrival timing t3 when a paper note having passed by the sensors (61, 62, 66, 67) for judgment of necessity of shift at the timing t1 of judgment arrives at the skew rollers (43, 47, 93, 97) for execution of shift after the lapse of conveyance time t2, preparations for shift have been completed and shift is started immediately when an end of the paper note comes into contact with the skew roller.

In addition, while shift is made, all the conveyance belts 15, 16, 17, 18 are revolved along the rollers at the same speed in the direction of conveyance in the same manner as before shift is made.

Such putting to the center continues after a paper note is once detected by the leftward-shift termination sensor 68 or the rightward-shift termination sensor 63 and until detection is not made (STEP n5), and when detection is not made, putting to the center is terminated after the lapse of a preset predetermined time (STEP n6).

In the case where rightward shift is to be terminated, termination of putting to the center makes power supply for the solenoid S3 OFF to increase pushing forces of the conveyance belts 17, 18 on the right, and makes power supply for the solenoid S1 OFF to retreat the skew execution roller 47 for rightward shift upward and to stop rotation of the motor M2 to stop rotation of the skew conveyance rollers 97 for rightward shift.

Also, in the case where leftward shift is to be terminated, power supply for the solenoid S4 is made OFF to increase pushing forces of the conveyance belts 15, 16 on the left, and power supply for the solenoid S2 is made OFF to retreat the skew execution roller 47 for leftward shift upward and to stop rotation of the motor M1 to stop rotation of the skew conveyance rollers 93 for leftward shift.

In this processing of termination of shift, the solenoids are de-energized and the skew conveyance rollers are stopped in timing t5 of termination, in which a predetermined time t4 lapses from a state, in which a paper note is not detected by the leftward-shift termination sensor 68 or the rightward-shift termination sensor 63. At a point of time when a separation time t6 has lapsed since then, the skew execution rollers 43, 47 separate from the paper note. In this manner, by terminating shift after time is adjusted by the predetermined time t4, the paper note is adjusted in distance of shift in the conveyance widthwise direction and positionally adjusted.

That is, in the case where a cassette is a little larger in width than paper notes, paper notes are not stored barely in a state of being a little put to the right or the left but may be put to the center as far as possible to be stably stored.

At this time, since power supply for the solenoids is made OFF to make switching in a state of not making shift, switching may be made in a short time to decrease offset due to response time as compared with the case where the construction is reversed to make switching to a state of not making shift when power supply for the solenoids is made ON.

The operations described above enable putting paper notes, which are put to the right or the left, to the center to appropriately store the same in a cassette corresponding to a size of the paper notes.

Figure 16:
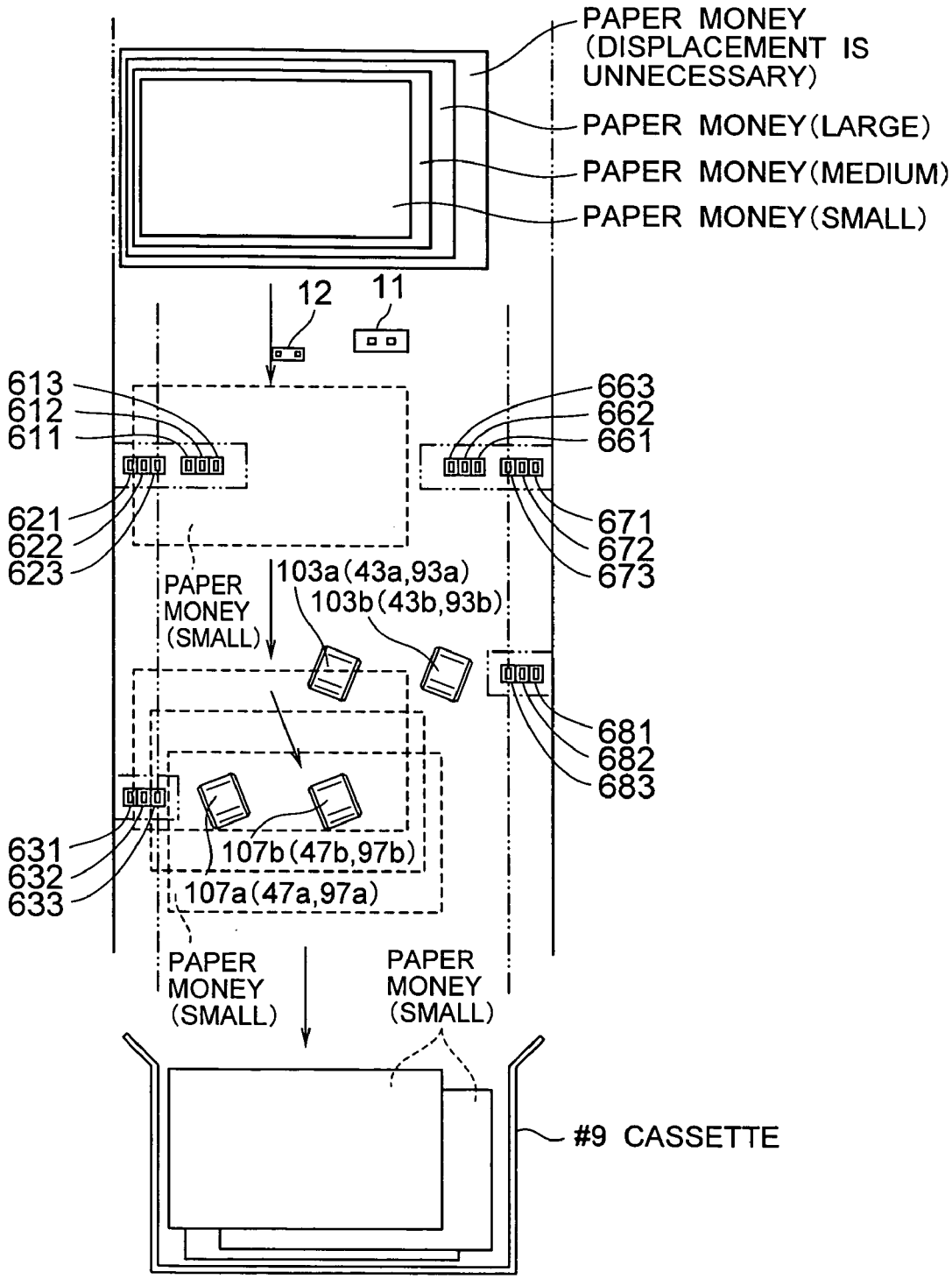
FIG. 16 is a plan view illustrating shift of paper notes.

Here, referring to an explanatory plan view of FIG. 16, a detailed explanation will be given to an example of paper notes (small) being stored in a #9 cassette. Thus an interval of paper notes (small) being conveyed downward from above in the figure is first detected by the paper note interval detection sensor 11, and skew is detected by the skew detection sensor 12.

Subsequently, since the paper note (small) shields the small-size rightward-shift start sensor 613 from light but does not shield the small-size leftward-shift start sensor 663 from light, the condition for putting to the center is met.

Accordingly, rightward shift is made in the processing of putting to the center in the STEP n4 (FIG. 14) such that the paper note is skewed rightward by rightward-shift roller pairs 107*a*, 107*b* composed of the skew execution rollers 47*a*, 47*b* and the skew conveyance rollers 97*a*, 97*b*, which serve for rightward shift.

In the meantime, the small-size rightward-shift termination sensor 633 detects the paper note (small), and when detection of the paper note (small) goes out, rightward shift is terminated after the lapse of a predetermined time. Thereafter, the paper note (small) is conveyed straight in a position after the shift and stored in a #9 cassette disposed in the latter stage.

In this manner, a paper note may be positionally shifted a distance, which is required for appropriately storing the paper note in a cassette, according to a size and a position of the paper note in a state of conveyance.

Also, since a large-sized paper note is not needed to be put to the center, it is detected and may be conveyed as it is.

Also, since a paper note being skewed does not make shift, it is possible to prevent generation of jam of paper notes. In particular, since ATM, etc. constructed to reject a paper note being skewed with the use of identification means disposed in the latter stage makes it unnecessary for the paper note being skewed to be put to the center, unnecessary processing are eliminated and efficiency may be heightened.

Figure 17A:
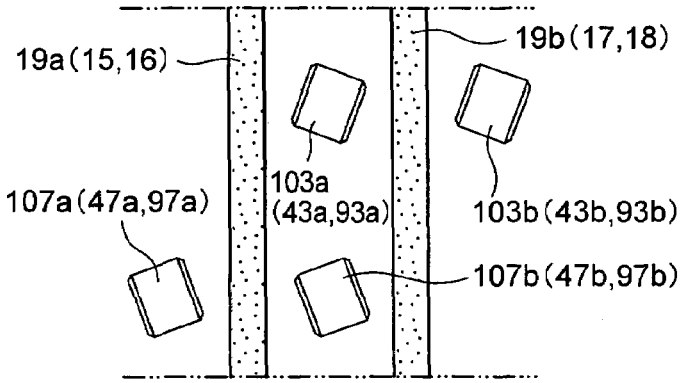
FIGS. 17A, 17B, and 17C are enlarged plan views illustrating conveyance and shift of paper notes.

As indicated by presence and absence of colored patterns in an illustration of FIG. 17A, a paper note may be stably conveyed by a conveyance belt pair 19*a* (a pair of 15 and 16) on the left and a conveyance belt pair 19*b* (a pair of 17 and 18) on the right so that a longitudinal direction of the paper note becomes in parallel to a widthwise direction of the conveyance path.

Figure 17B:
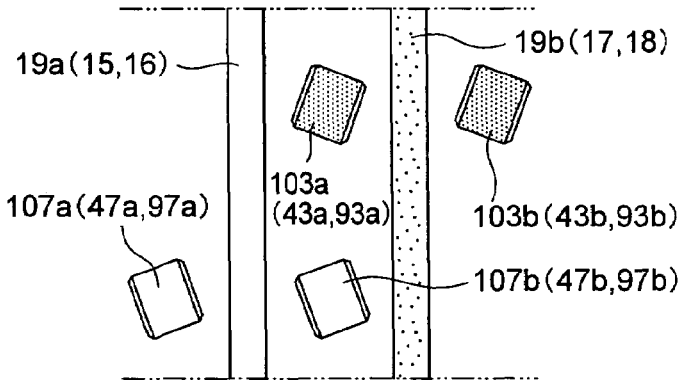

When a paper note is to be shifted leftward to be put to the center, putting to the center may be stably performed by decreasing pushing forces of the conveyance belt pair 19*a* and making leftward-shift roller pairs 103*a* (43*a*, 93*a*), 103*b* (43*b*, 93*b*) effective as shown in FIG. 17B.

That is, since the leftward-shift roller pairs 103*a*, 103*b* strongly push the paper note on the left and the right of the conveyance belt pair 19*b* on the right to shift the same, fold and wrinkle are not generated on the paper note between the leftward-shift roller pairs 103*a*, 103*b*, and the conveyance belt pair 19*a* does not obstruct leftward shift.

Also, even when pushing forces concentrate on one point over a roller width due to manufacturing accuracies of the respective rollers, the two leftward-shift roller pairs 103*a*, 103*b* push a paper note, so that the paper note may be prevented from skewing at the time of shift.

Also, since the conveyance belt pair 19*b* on the right is put in a state capable of conveying paper notes during leftward shift, a paper note in conveyance may be shifted without being released and also, after termination of shift, the conveyance belt pair 19*b* may instantly convey the paper note without releasing the same. Accordingly, the paper note is interposed at all times to stably enable conveyance, shift, and switching of conveyance.

Figure 17C:
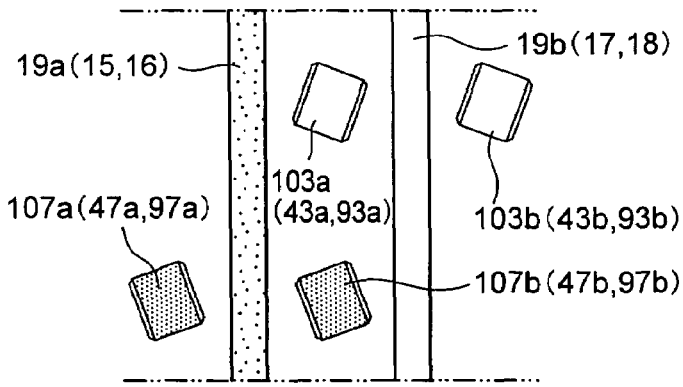

When a paper note is to be shifted rightward to be put to the center, the effect described above may be produced by those operations, which are left-right symmetric with respect to the above as shown in FIG. 17C.

Also, since the shift is terminated after the lapse of a predetermined time after detection of a paper note by the shift termination sensors 63, 68, the paper note after shift may be correctly adjusted in position. In addition, the predetermined time may be set to 0 second, in which case a paper note after shift may also be correctly adjusted in position because detection by the shift termination sensors 63, 68 is utilized.

A spacing from the sensors (61, 62, 66, 67) for judgment of necessity of shift to the skew rollers (43, 93) nearer thereto is set to a predetermined distance. Therefore, motions required for shift may be completed until a paper note arrives at the skew rollers after passing through the sensors, so that shift may be made stably and correctly.

In particular, by ensuring a distance required for response of the solenoids as the predetermined distance, the skew rollers (43, 93) come into contact with a forward end of a paper note in the direction of conveyance, thus making the maximum use of a width of the paper note in a short-side direction (the direction of conveyance) to enable making shift.

In addition, in the above-described embodiment, the conveyance belt pairs 19*a*, 19*b* are not limited to two pairs but may be provided in a suitable number of pairs and arranged appropriately. Also, while the leftward-shift roller pairs 103*a*, 103*b* comprise two roller pairs juxtaposed in the conveyance widthwise direction and provided with rollers arranged vertically in opposition to each other, they are not limited thereto but may comprise one or two or more roller pairs provided in a suitable number and arranged appropriately.

Figure 18A:
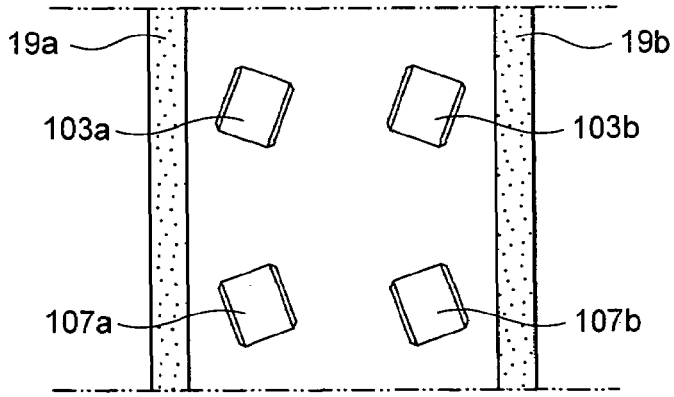
FIGS. 18A, 18B, and 18C are views of another embodiment.
Figure 18B:
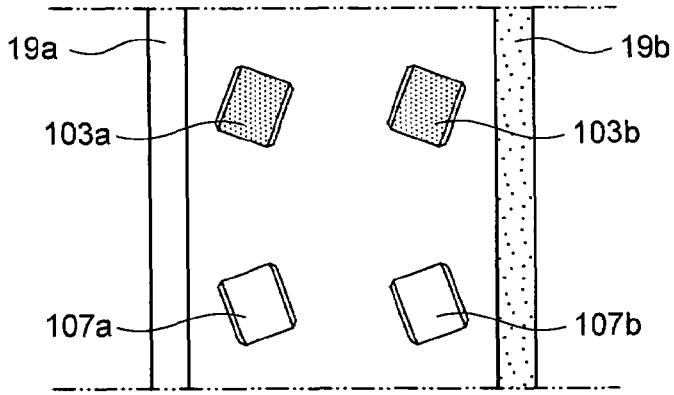
Figure 18C:
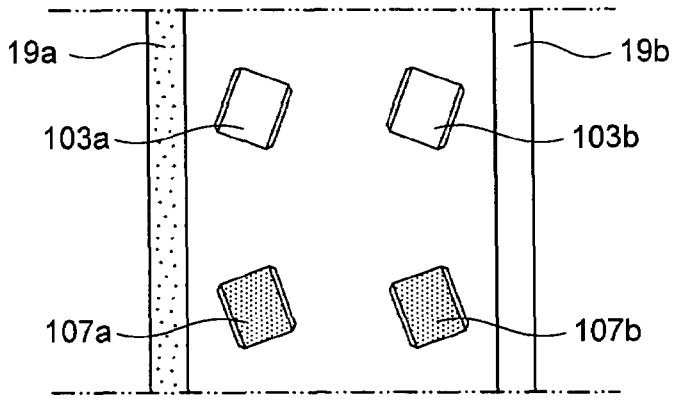

Specifically, the leftward-shift roller pairs 103*a*, 103*b* and the rightward-shift roller pairs 107*a*, 107*b* may be provided between the two pairs of conveyance belt pairs 19*a*, 19*b* as shown in illustrations of FIGS. 18A, 18B, and 18C.

In this case, the conveyance belt pairs 19*a*, 19*b*, the leftward-shift roller pairs 103*a*, 103*b*, and the rightward-shift roller pairs 107*a*, 107*b* suffice to be the same in motion as in the embodiment described above.

Figure 19A:
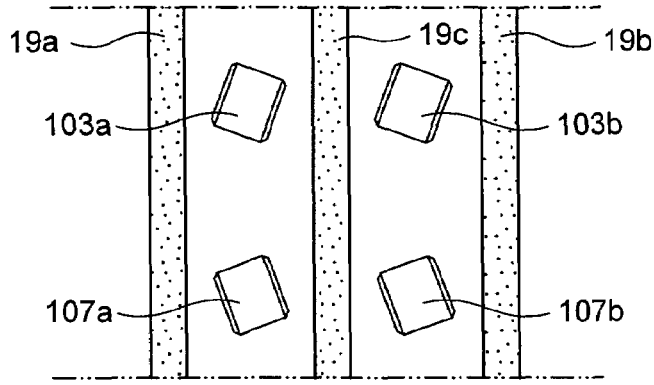
FIGS. 19A, 19B, and 19C are views of a further embodiment.
Figure 19B:
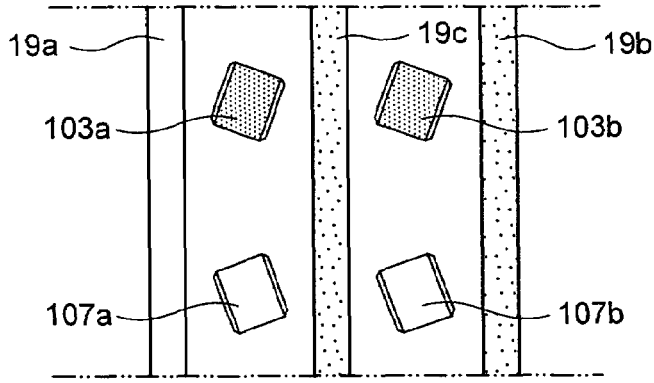
Figure 19C:
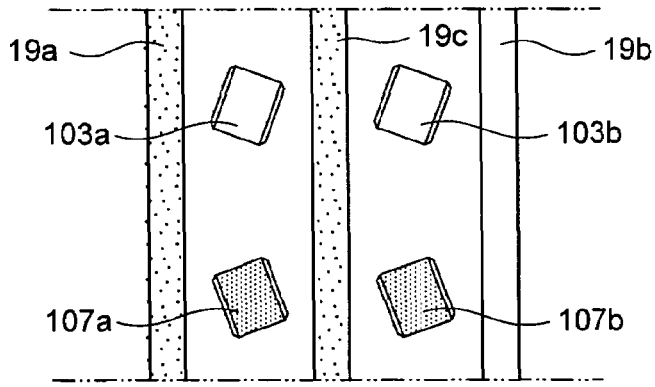

Also, three pairs of conveyance belt pairs 19*a*, 19*b*, 19*c* may be used and a central conveyance belt pair 19*c* may be interposed between the leftward-shift roller pairs 103*a*, 103*b* and the rightward-shift roller pairs 107*a*, 107*b* as shown in illustration of FIGS. 19A, 19B, and 19C.

In this case, it suffices that the central conveyance belt pair 19*c* has a pushing force at all times to convey a paper note and pushing forces of the left and right conveyance belt pairs 19*a*, 19*b* be switched over.

Also, the conveyance belt pairs 19*a*, 19*b* on both sides in the embodiment may be rotated in the direction of conveyance at the same speed as that of the central conveyance belt pair 19*c* and always decreased in pushing forces on a paper note not to obstruct shift at the time of shift even without switching in pushing force.

Figure 20A:
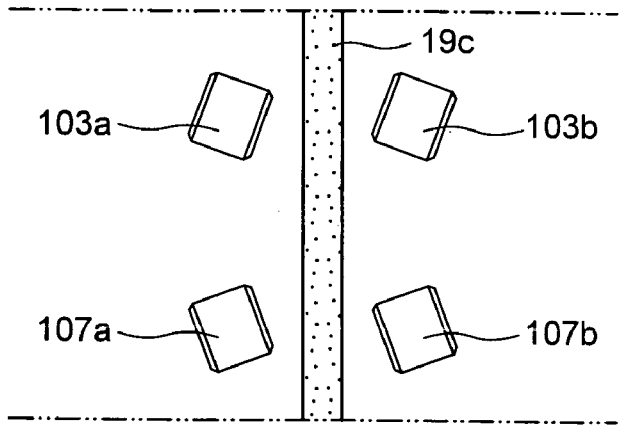
FIGS. 20A, 20B, and 20C are views of a further embodiment.
Figure 20B:
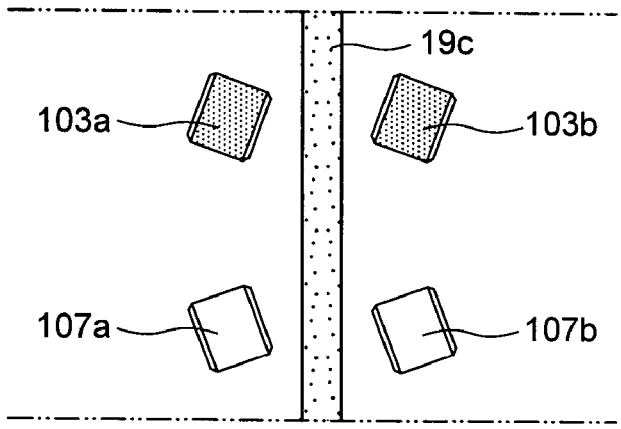
Figure 20C:
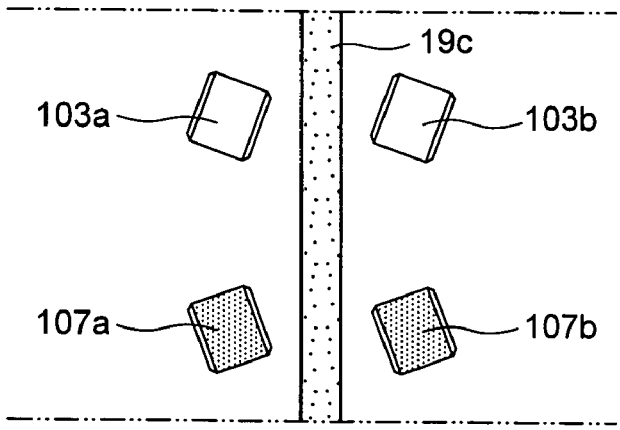

Also, only one conveyance belt pair 19*c* may be used and the conveyance belt pair 19*c* may be interposed between the leftward-shift roller pairs 103*a*, 103*b* and the rightward-shift roller pairs 107*a*, 107*b* as shown in FIGS. 20A, 20B, and 20C.

In this case, it is not necessary to change a pushing force of the conveyance belt pair.

Figure 21A:
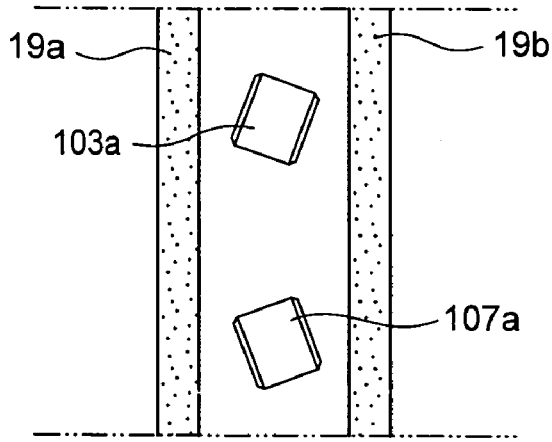
FIGS. 21A, 21B, and 21C are views of a still further embodiment.
Figure 21B:
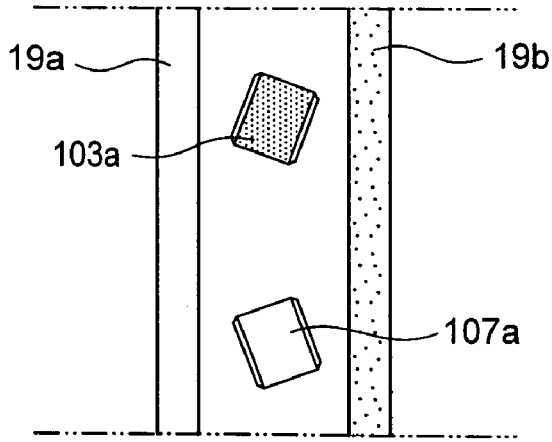
Figure 21C:
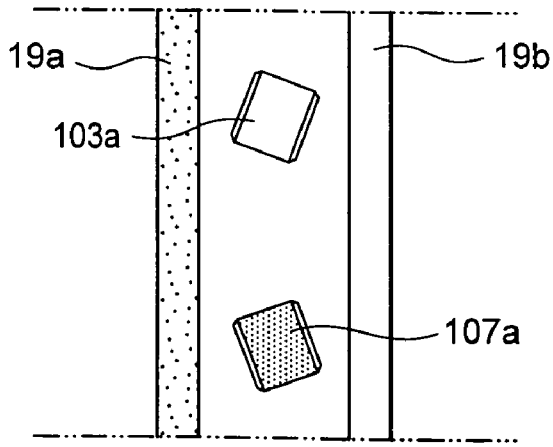

Also, two conveyance belt pairs 19*a*, 19*b* may be juxtaposed and the leftward-shift roller pair 103*a* and the rightward-shift roller pair 107*a* may be arranged therebetween as shown in FIGS. 21A, 21B, and 21C.

In this case, it suffices that a shift conveyance speed of a component in the direction of conveyance in the case where a paper note is shifted by the leftward-shift roller pair 103*a* and the rightward-shift roller pair 107*a* be set to the same as conveyance speeds of the conveyance belt pairs 19*a*, 19*b*.

Also, while both the skew execution rollers 43, 47 and the skew conveyance rollers 93, 97 are formed from a roller having an appropriate width, they may be formed from a body of rotation in the form of a circular disk having a small width. Also in this case, the construction of the embodiment makes it possible to prevent a paper note from skewing at the time of shift, and other effects may be produced.

Also, in place of the conveyance belts 15, 16, 17, 18, plural roller pairs provided with rollers arranged vertically in opposition to each other may be arranged in the direction of conveyance and shift may be made by the roller pairs.

In this case, while rollers are increased in number as compared with the case where conveyance belts are used, arrangement and control in the embodiment make it possible to positionally shift a paper note stably.

Also, while shift assumes the form of putting to the center, it may assume the form of putting to the right or the left. It suffices that this case be realized by detection by the rightward-shift termination sensor 63 and the leftward-shift termination sensor 68 and regulation of time until termination of shift after detection of paper note are adjusted.

Thereby, putting to the center is not always necessary but a paper note may be appropriately shifted to a desired position.

Also, while LEDs and phototransistors of the sensors (61, 62, 66, 67) for judgment of necessity of shift are constructed by a combination of pairs, which are smaller in number than cassettes distributed according to sizes of paper notes, they may be constructed by pairs, which are the same in number as cassettes.

Also, LEDs and phototransistors of the sensors (61, 62, 66, 67) for judgment of necessity of shift may be constructed by a combination of one pair.

Also, the sensors (61, 62, 66, 67) for judgment of necessity of shift and/or the sensors (63, 68) for judgment of termination of shift may comprise detection means based on picture processing and composed of imaging means such as CCD, etc., in place of the combination of LEDs and phototransistors.

In this case, the imaging means may comprise respective ones for leftward-shift start, leftward-shift stop, rightward-shift start, rightward-shift stop, leftward-shift termination, and rightward-shift termination. Alternatively, the imaging means for leftward-shift start and the imaging means for leftward-shift stop may be made into one unit and the imaging means for rightward-shift start and the imaging means for rightward-shift stop may be made into one unit. Alternatively all of the imaging means may be made in one unit.

Such imaging means may detect a range linearly unlike one point with LED whereby only change in software may cope with switching of corresponding paper notes, for example, from domestic paper notes to foreign paper notes.

Also, by means of measures to use an elastic member such as a rubber member, etc. for born portions of rotating shafts of, for example, the skew execution rollers 43, 47, pushing forces may be applied evenly on those surfaces thereof, which push the skew conveyance rollers 93, 97.

In this case, it is possible to omit the leftward-shift roller pair 103*b* and the rightward-shift roller pair 107*a* to cause one shift roller pair (103*a* or 107*b*) to make shift without skew.

In this case, it is possible to increase adjustable shift distances in kind. Accordingly, even when an inside width of a cassette is made nearer to a length of a paper note being stored in a longitudinal direction thereof than that in the embodiment, setting is made possible to surely store paper notes.

In correspondence of the constitution of the invention to the embodiment described above:

a sheet handling apparatus of the invention corresponds to the paper note shift apparatus 1 of the embodiment;

shift presence and absence switching means corresponds to the control unit 10 that executes STEP n1 to STEP n3;

conveyance belt pair corresponds to the conveyance belt pairs 19*a*, 19*b*;

conveyance means corresponds to the conveyance belt pairs 19*a*, 19*b*, 19*c*;

first conveyance means corresponds to the conveyance belt pair 19*a* in case of rightward shift, the conveyance belt pair 19*b* in case of leftward shift, and the conveyance belt pair 19*c* in case of both rightward shift and leftward shift;

second conveyance means corresponds to the conveyance belt pair 19*a* in case of leftward shift and the conveyance belt pair 19*b* in case of rightward shift;

a rotating member corresponds to the rollers 21, 23, 25, 27, 29, 31, 33, 35 and the rollers 71, 73, 75, 77, 79, 81, 83, 85;

shift means, a contact region, and a body of rotation correspond to the skew execution rollers 43, 47 and the skew conveyance rollers 93, 97;

pushing-force switching means corresponds to the belt inclining drive unit 90;

a body of rotation pair corresponds to the leftward-shift roller pairs 103*a*, 103*b* and the rightward-shift roller pairs 107*a*, 107*b*;

a drive unit corresponds to the motors M1, M2;

a sheet corresponds to paper notes; and a side in a direction of shift corresponds to a center in the conveyance widthwise direction.

The invention is not limited to only the construction of the embodiment but may assume various embodiments.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A sheet handling apparatus comprising:

a pay-in and pay-out mouth through which a paper note is paid in or paid out;

conveyance means, including a conveyance belt, for conveying a paper note;

a discrimination part to discriminate authenticity and denomination of a conveyed paper note;

a temporary hold part to temporarily hold a discriminated paper note;

a storing part to store the discriminated paper note which was temporarily held in the temporary hold part and supplied therefrom for storage in the storing part;

shift means to shift position of a paper note in a width direction of conveyance;

wherein the shift means is provided on a conveyance path of the discriminated paper note connecting the temporary hold part and the discrimination part;

wherein the shift means rotates in a direction inclined relative to a direction of conveyance of the paper note and comes into contact with the discriminated paper note to shift a position of the discriminated paper note in a widthwise direction of conveyance; and the shift means includes shift presence and absence switching means for switching between a shift execution state, in which shift of the discriminated paper note is executed by the shift means, and a shift non-execution state, in which the shift is not executed by the shift means; and at least a part of that contact portion of the shift means, which comes into contact with a surface of the discriminated paper note, is positioned at a shift direction side relative to the conveyance means, which has a conveyance force during shift, and a frictional force of the shift means on the discriminated paper note at the time of execution of shift is set to be larger than that of the conveyance means on the discriminated paper note; and wherein the conveyance belt is provided opposingly on upper and lower sides to have conveyance surfaces abutting against each other to form a conveyance belt pair, the conveyance belt pair is provided two in juxtaposition in a widthwise direction of conveyance, the respective conveyance belt pairs are provided with pushing-force switching means for switching of a pushing force on the conveyance surface, the shift means comprises four pairs of bodies of rotation with the bodies of rotation provided opposingly on upper and lower sides and with directions of rotations inclined inward relative to the direction of conveyance, the respective pairs of bodies of rotation are arranged in positions, in which the conveyance belt pair is interposed between two pairs of bodies of rotation in the widthwise direction of conveyance, for the respective conveyance belt pairs, the shift presence and absence switching means is constructed to switch every two pairs of bodies of rotation, which interpose therebetween the conveyance belt pair, between a shift execution state, in which the upper and lower bodies of rotation are caused to approach each other to execute shift of the discriminated paper note, and a shift non-execution state, in which the upper and lower bodies of rotation are separated from each other not to execute shift of the discriminated paper note, and when the discriminated paper note on a right side is to be put to a center, two pairs of bodies of rotation, which interpose therebetween the conveyance belt pair on the right side, is switched over to the shift execution state and a pushing force of the conveyance belt pair on left side is decreased, and when the discriminated paper note on the left side is to be put to the center, two pairs of bodies of rotation, which interpose therebetween the conveyance belt pair on the left side, is switched over to the shift execution state and a pushing force of the conveyance belt pair on the right side is decreased.

2. A sheet handling apparatus according to claim 1, wherein the shift means corrects posture of the discriminated paper note conveyed from the temporary hold part and the discrimination part checks result of the corrected discriminated paper note.

3. A sheet handling apparatus according to claim 1, wherein the apparatus includes paid-in money counting process to discriminate paper notes paid in from the pay-in and pay-out mouth to temporarily hold the discriminate paper notes in the temporary hold part and paid-in money storing process to discriminate paper notes conveyed from the temporary hold part to store the discriminate paper notes in the storing part, and the shift means corrects posture of the discriminated paper notes only in the paid-in money storing process among the paid-in money counting process and the paid-in money storing process.

4. A sheet handling apparatus according to claim 1, wherein the shift means is provided on a conveyance path positioned on the most upstream position of the sheet handling apparatus.

5. A sheet handling apparatus according to claim 1, wherein the discrimination part includes position detection means to detect a position, in a widthwise direction of conveyance, of the discriminated paper note conveyed through the shift means, and determines storing location of the discriminated paper note on the basis of result detected by the detection means.

6. A sheet handling apparatus according to claim 1, wherein the conveyance means comprises a conveyance belt stretched round appropriate rotating members and a drive unit that drivingly rotates the rotating members.

7. A sheet handling apparatus according to claim 1, wherein the shift means comprises two or more bodies of rotation juxtaposed in the widthwise direction of conveyance.

8. A sheet handling apparatus according to claim 7, wherein the conveyance means having a conveyance force also during shift of the discriminated paper note is arranged between the bodies of rotation in juxtaposition.

9. A sheet handling apparatus according to claim 7, wherein the conveyance means having a conveyance force also during shift of the discriminated paper note is arranged on a side opposite to any one of the two or more bodies of rotation in the direction of conveyance caused by the bodies of rotation.

10. A sheet handling apparatus according to claim 1, wherein the conveyance means having a conveyance force also during shift forms first conveyance means, and further comprising:

second conveyance means provided at further side of the shift direction than the bodies of rotation positioned at the side of the shift direction, and pushing-force switching means that increases a pushing force of the second conveyance means on the discriminated paper note to cause the same to cooperate with the first conveyance means to convey the discriminated paper note when the sheet is not to be shifted, and decreases the pushing force on the discriminated paper note so as not to obstruct shift of the sheet when the sheet is to be shifted.

11. A sheet handling apparatus according to claim 1, wherein the conveyance means conveys a paid-in paper note from the pay-in and pay-out mouth to the temporary hold part, from the temporary hold part to the discrimination part via the shift means, and from the discrimination part to the storing part.

12. A sheet handling apparatus according to claim 11, wherein the conveyance means initially conveys the paid-in paper note from the pay-in and pay-out mouth to the temporary hold part via the discrimination part so that the temporary hold part temporarily holds the discriminated paid-in paper note, and further conveys the paid-in discriminated paper note from the temporary hold part again to the discrimination part via the shift means.

13. A sheet handling apparatus according to claim 1, wherein when the conveyance means conveys the discriminated paper note from the temporary hold part to the storing part, the shift means corrects posture of the discriminated paper note conveyed from the temporary hold part and the discrimination part checks result of the corrected discriminated paper note.

14. A sheet handling apparatus according to claim 1, wherein during a paying-in transaction in which the paper note is paid in the pay-in and pay-out mouth of the sheet handling apparatus from outside of the sheet handling apparatus, the paper note after being discriminated and temporarily held in the temporary hold part is stored in the storing part so as to complete the paying-in transaction.

* * * * *